US011476036B2

(12) United States Patent
Noo et al.

(10) Patent No.: US 11,476,036 B2
(45) Date of Patent: Oct. 18, 2022

(54) INDUCTOR COMPONENT

(71) Applicant: Murata Manufacturing Co., Ltd., Kyoto-fu (JP)

(72) Inventors: Naoya Noo, Nagaokakyo (JP); Yoshimasa Yoshioka, Nagaokakyo (JP); Kouji Yamauchi, Nagaokakyo (JP); Akinor Hamada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 372 days.

(21) Appl. No.: 16/851,233

(22) Filed: Apr. 17, 2020

(65) Prior Publication Data

US 2020/0395165 A1 Dec. 17, 2020

(30) Foreign Application Priority Data

Jun. 17, 2019 (JP) ..... JP2019-112207

(51) Int. Cl.
*H01F 27/28* (2006.01)
*H01F 27/255* (2006.01)
(Continued)

(52) U.S. Cl.
CPC ..... *H01F 27/2804* (2013.01); *H01F 1/147* (2013.01); *H01F 1/36* (2013.01); *H01F 1/37* (2013.01); *H01F 17/04* (2013.01); *H01F 27/255* (2013.01); *H01F 41/0246* (2013.01); *H01F 41/041* (2013.01); *H01F 17/0013* (2013.01); *H01F 27/292* (2013.01); *H01F 2017/048* (2013.01); *H01F 2027/2809* (2013.01); *Y10T 428/32* (2015.01)

(58) Field of Classification Search
None
See application file for complete search history.

(56) References Cited

U.S. PATENT DOCUMENTS 8,427,265 B2 * 4/2013 Hachiya ..... H01F 17/0013 336/83
9,287,026 B2 * 3/2016 Matsuura ..... C22C 38/18
(Continued)

FOREIGN PATENT DOCUMENTS

JP 2012-238840 A 12/2012
JP 6024243 B2 11/2016
(Continued)

OTHER PUBLICATIONS

An Office Action; "Notice of Reasons for Refusal," mailed by the Japanese Patent Office dated Jan. 18, 2022, which corresponds to Japanese Patent Application No. 2019-112207 and is related to U.S. Appl. No. 16/851,233 with English language translation.

*Primary Examiner* — Kevin M Bernatz
(74) *Attorney, Agent, or Firm* — Studebaker & Brackett PC

(57) ABSTRACT

An inductor component includes a multilayer body including a magnetic layer and a spiral wiring line disposed in the multilayer body. The magnetic layer includes a base resin, a metal magnetic powder, and a non-magnetic powder. The base resin has voids, and the metal magnetic powder and the non-magnetic powder are contained in the base resin. There is a particle of the metal magnetic powder that is in contact with at least one of the voids and with the non-magnetic powder.

20 Claims, 16 Drawing Sheets

(51) Int. Cl.

| | |
|---|---|
| ***H01F 1/36*** | (2006.01) |
| ***H01F 1/147*** | (2006.01) |
| ***H01F 1/37*** | (2006.01) |
| ***H01F 17/04*** | (2006.01) |
| ***H01F 41/04*** | (2006.01) |
| ***H01F 41/02*** | (2006.01) |
| *H01F 27/29* | (2006.01) |
| *H01F 17/00* | (2006.01) |

(56) References Cited

U.S. PATENT DOCUMENTS

| | | | | |
|---|---|---|---|---|
| 10,580,564 | B2 * | 3/2020 | Ju | H01F 17/04 |
| 2012/0274438 | A1 | 11/2012 | Hachiya et al. | |
| 2014/0009254 | A1 * | 1/2014 | Oh | H01F 17/0033 336/192 |
| 2018/0182538 | A1 * | 6/2018 | Choi | H01F 41/10 |
| 2019/0074125 | A1 | 3/2019 | Yoshioka et al. | |
| 2019/0333665 | A1 * | 10/2019 | Maruyama | H01F 1/14758 |

FOREIGN PATENT DOCUMENTS

| | | | |
|---|---|---|---|
| JP | 2019-046993 | A | 3/2019 |
| WO | 2018/194099 | A1 | 10/2018 |

* cited by examiner

INDUCTOR COMPONENT

CROSS-REFERENCE TO RELATED APPLICATION

This application claims benefit of priority to Japanese Patent Application No. 2019-112207, filed Jun. 17, 2019, the entire content of which is incorporated herein by reference.

BACKGROUND

Technical Field

The present disclosure relates to an inductor component.

Background Art

As described in Japanese Patent No. 6024243, an inductor component that is installed in an electronic device includes, for example, a pair of magnetic layers that include a resin and a metal magnetic powder contained in the resin and a spiral wiring line sandwiched between the pair of magnetic layers.

In the inductor component described in Japanese Patent No. 6024243, it is preferable that the content of the metal magnetic powder in each of the magnetic layers be 90 wt % to 97 wt % and that the content of the resin in each of the magnetic layers be 3 wt % to 10 wt %. The spiral wiring lines are each formed on one of the two surfaces of a substrate and are each covered with an insulator, which contains a resin and has an insulating property. Each of the insulators prevents the corresponding spiral wiring line and one of the magnetic layers from being electrically connected to each other. The pair of magnetic layers cover the insulators from opposite sides in a thickness direction.

SUMMARY

In recent years, electronic devices such as laptop personal computers and smartphones have been reduced in size and thickness. With reduction of the sizes and the thicknesses of electronic devices, inductor components that are installed in such electronic devices also have been desired to be smaller and thinner.

A spiral wiring line, an insulator, and a resin or a metal magnetic powder that is included in a magnetic layer expand and contract due to temperature changes, and the degrees of their expansion and contraction are different from one another. Thus, stress such as deformation due to heat may sometimes be accumulated. In particular, when an inductor component is mounted on a mounting substrate, stress is further accumulated due to the differences in the degrees of expansion and contraction between the mounting substrate, solder that joins the mounting substrate and the inductor component to each other, and the inductor component, and cracks may sometimes be generated in the inductor component or the solder.

Here, as in Japanese Patent No. 6024243, when the content of metal magnetic powder in a magnetic layer is set to 90 wt % to 97 wt %, the degrees of expansion and contraction of the magnetic layer becomes closer to the degrees of expansion and contraction of a piece of glass cloth included in a mounting substrate and to the degrees of expansion and contraction of a spiral wiring line made of a metal, and thus, stress reduction can be achieved. However, in this case, the insulating property of the magnetic layer deteriorates, and thus, it is necessary to, for example, coat the magnetic layer, the metal magnetic powder, and the spiral wiring line with an insulator. This leads to undesirable effects such as increase in the manufacturing costs due to an increase in the workload or increase in size and thickness due to an additional structure.

Accordingly, the present disclosure provides an inductor component capable of achieving stress reduction and improvement in an insulating property.

An inductor component according to preferred embodiments of the present disclosure includes a multilayer body including a magnetic layer and an inductor wiring line disposed in the multilayer body. The magnetic layer includes a base resin, a metal magnetic powder, and a non-magnetic powder, the base resin having voids, and the metal magnetic powder and the non-magnetic powder being contained in the base resin. The metal magnetic powder has a particle that is in contact with at least one of the voids and with the non-magnetic powder.

According to the above-described preferred embodiments, stress reduction and improvement in an insulating property can be achieved by at least one of the voids that is in contact with the metal magnetic powder and the non-magnetic powder that is in contact with the metal magnetic powder.

Note that, in the present specification, the term "inductor wiring line" refers to a wiring line that gives an inductance to the inductor component by generating a magnetic flux in the magnetic layer when a current flows therethrough, and the structure, the shape, the material, and so forth of the inductor wiring line are not particularly limited.

An inductor component according to an aspect of the present disclosure can achieve stress reduction and improvement in an insulating property.

Other features, elements, characteristics and advantages of the present disclosure will become more apparent from the following detailed description of the present disclosure with reference to the attached drawings.

DETAILED DESCRIPTION

Inductor components according to embodiments will be described below. Note that some components may sometimes be illustrated in an enlarged manner in the accompanying drawings for ease of understanding. The dimensional ratios of the components may sometimes be different from the dimensional ratios of actual components or may sometimes differ between the drawings. In addition, although the components are illustrated by hatching in the sectional views, the hatching may sometimes be omitted for some of the components for ease of understanding.

First Embodiment

An inductor component according to a first embodiment will be described below.

Figure 1:
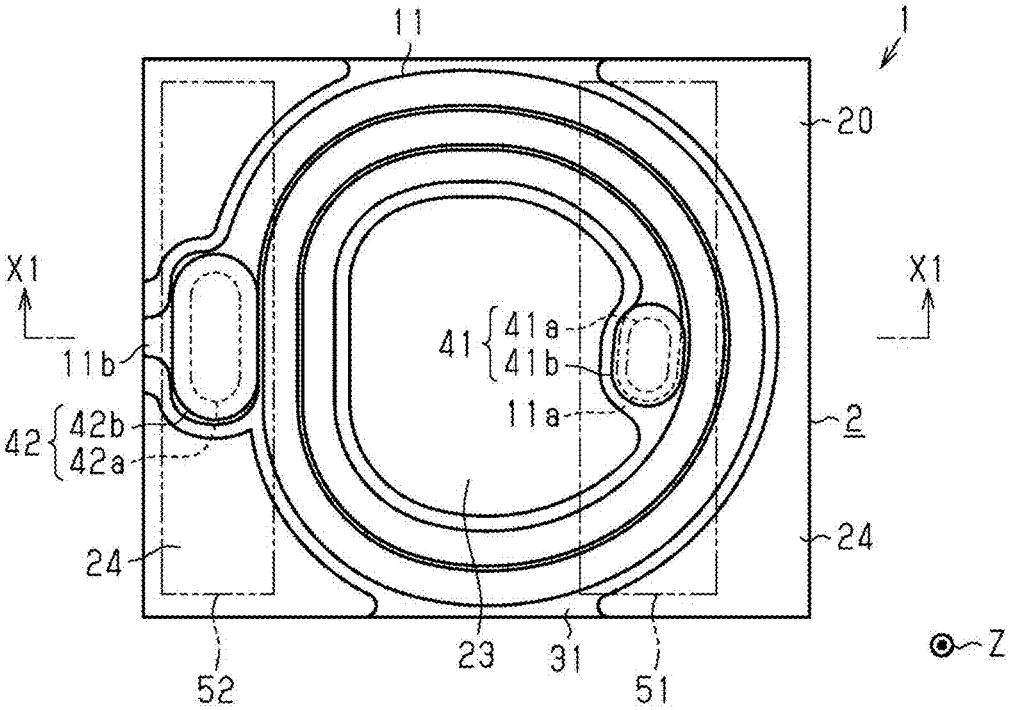
FIG. 1 is a plan view illustrating an inductor component according to a first embodiment in a see-through manner.

An inductor component 1 illustrated in FIG. 1 is, for example, a surface mount inductor component that is installed in an electronic device such as a personal computer, a DVD player, a digital camera, a television, a cellular phone, or car electronics. The inductor component 1 is, for example, a power inductor that is used in a power-supply circuit of an electronic device. However, the application of the inductor component 1 is not limited to the above.

Figure 2:
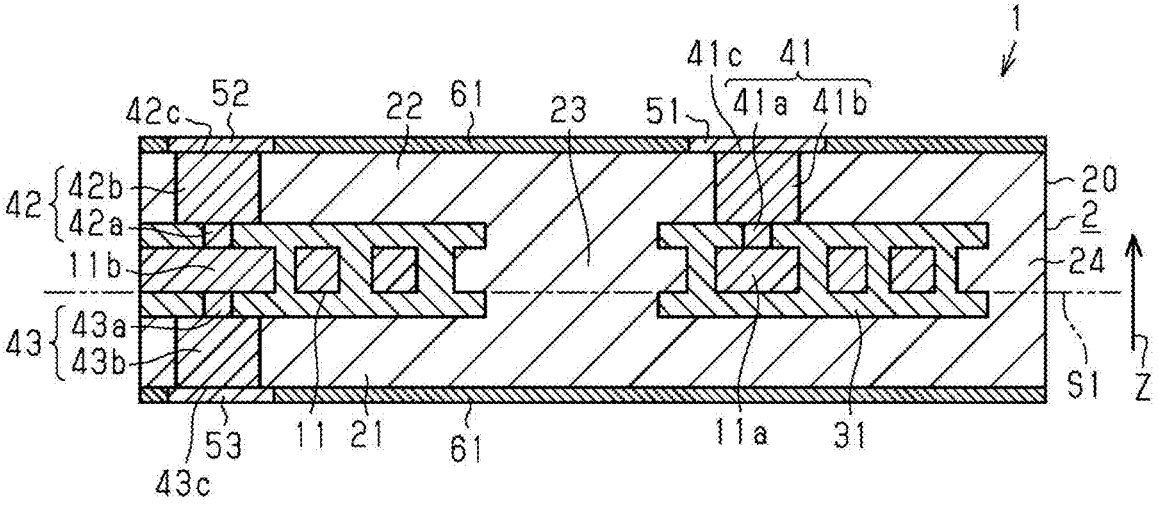
FIG. 2 is a sectional view of the inductor component according to the first embodiment (a sectional view taken along line X1-X1 of FIG. 1)
Figure 3:
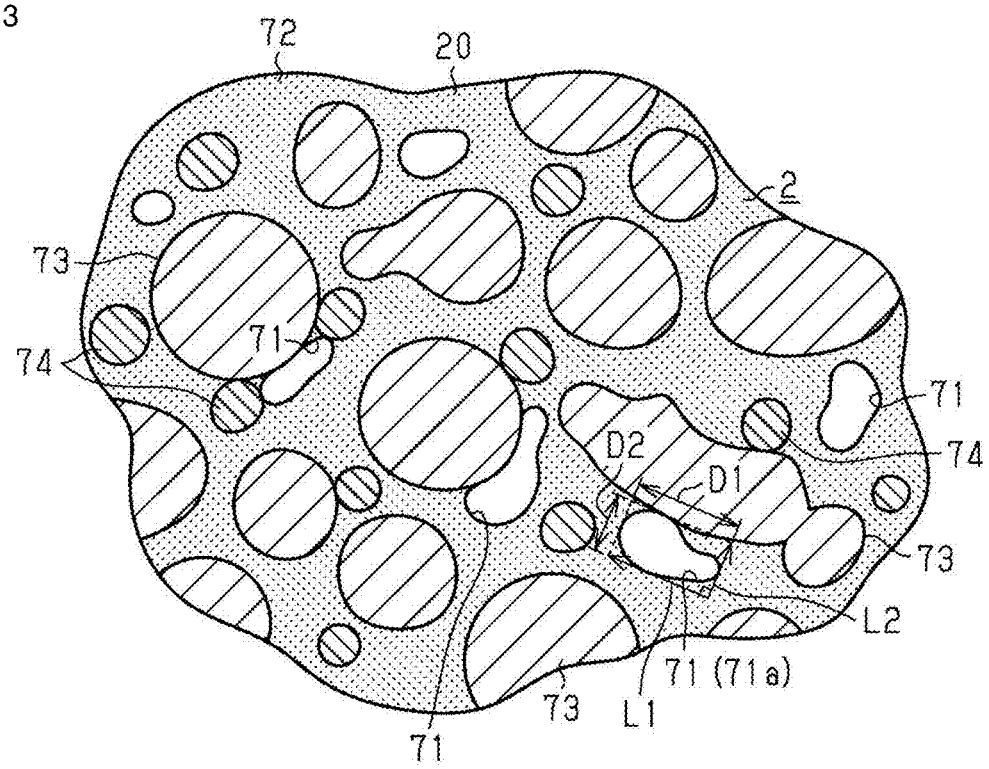
FIG. 3 is an enlarged sectional view of the inductor component according to the first embodiment.

As illustrated in FIG. 1 to FIG. 3, the inductor component 1 includes a multilayer body 2 including a magnetic layer 20 and a spiral wiring line 11 disposed in the multilayer body 2. The magnetic layer 20 includes a base resin 72, a metal magnetic powder 73, and a non-magnetic powder 74. The base resin 72 has voids 71, and the metal magnetic powder 73 and the non-magnetic powder 74 are contained in the base resin 72. There is a particle of the metal magnetic powder 73 that is in contact with at least one of the voids 71 and with the non-magnetic powder 74. Note that the spiral wiring line 11 is an example of an inductor wiring line.

As illustrated in FIG. 1 and FIG. 2, the inductor component 1 according to the present embodiment has a rectangular parallelepiped shape. Note that, in the present specification, the term "rectangular parallelepiped shape" includes a shape having irregularities formed on a portion or the entirety of each surface thereof. In addition, each surface of the "rectangular parallelepiped shape" in the present specification does not need to be completely parallel to one of the surfaces that is opposite the surface, and the opposing surfaces may be slightly inclined with respect to each other (i.e., adjacent surfaces do not need to be at right angles to each other). Note that the shape of the inductor component 1 is not particularly limited and may be, for example, a columnar shape, a polygonal columnar shape, a truncated conical shape, or a polygonal truncated pyramidal shape.

The inductor component 1 includes the spiral wiring line 11, the multilayer body 2, vertical wiring lines 41, 42, and 43, external terminals 51, 52, and 53, and coating films 61.

The spiral wiring line 11 is made of an electrically conductive material and is wound on a plane. A direction perpendicular to a plane S1 on which the spiral wiring line 11 is wound corresponds to the Z-axis direction in the drawings (the vertical direction in FIG. 2). In the following description, the positive Z-axis direction corresponds to the upward direction, and the negative Z-axis direction corresponds to the downward direction. In addition, the Z-axis direction corresponds to the thickness direction of the inductor component 1. Note that the Z-axis direction is common to other embodiments and modifications. When viewed from above, the spiral wiring line 11 is formed to extend in a spiral manner in the counterclockwise direction from an inner periphery end 11*a* to an outer periphery end 11*b*. In addition, the Z-axis direction also matches a lamination direction of the multilayer body 2.

In the present embodiment, the number of turns of the spiral wiring line 11 is 2.5 turns. It is preferable that the number of turns of the spiral wiring line 11 be 5 turns or less. If the number of turns is 5 turns or less, a loss due to proximity effect in a switching operation at a high frequency ranging from 50 MHz to 150 MHz can be reduced. In contrast, when the inductor component 1 is used in a switching operation at a low frequency, which is, for example, 1 MHz, it is preferable that the number of turns of the spiral wiring line 11 be 2.5 turns or greater. By increasing the number of turns of the spiral wiring line 11, the inductance of the inductor component 1 can be increased, and inductor ripple current can be reduced. Note that the number of turns of the spiral wiring line 11 may be greater than 5 turns.

For example, a low-resistance metal such as copper (Cu), silver (Ag), or gold (Au) can be used as a material of the spiral wiring line 11. Preferably, a conductor made of copper or a copper compound is used as the material of the spiral wiring line 11. In this case, the manufacturing costs of the spiral wiring line 11 can be reduced, and the direct-current resistance of the spiral wiring 11 can be reduced. In addition, it is preferable that the spiral wiring line 11 be formed of copper plating that is formed by a semi-additive process (SAP). In this case, the low-resistance spiral wiring line 11 with a narrow pitch can be obtained at low cost. Note that the spiral wiring line 11 may be formed by, for example, a plating method other than the SAP, or by a sputtering method, a deposition method, or an application method.

Note that the term "spiral wiring line" mentioned above refers to a wiring line formed in a planar curve (a two-dimensional curve) and may also refer to a wiring line formed in a curve that is wound in less than one turn or may also refer to a wiring line a portion of which has a linear shape.

The multilayer body 2 includes the magnetic layer 20 and an insulator 31. The magnetic layer 20 is made of a magnetic material. The magnetic layer 20 includes a first magnetic layer 21, a second magnetic layer 22, an internal-magnetic-path portion 23, and an external-magnetic-path portion 24.

The first magnetic layer 21 and the second magnetic layer 22 are positioned so as to sandwich the spiral wiring line 11 from opposite sides in the Z-axis direction. More specifically, the first magnetic layer 21 is positioned below the spiral wiring line 11, and the second magnetic layer 22 is positioned above the spiral wiring line 11. In other words, the spiral wiring line 11 is sandwiched between the first magnetic layer 21 and the second magnetic layer 22. The internal-magnetic-path portion 23 is positioned in an area enclosed by the spiral wiring line 11. In other words, in the magnetic layer 20, the internal-magnetic-path portion 23 is a portion that is sandwiched between the first magnetic layer 21 and the second magnetic layer 22 while being positioned in the area enclosed by the spiral wiring line 11. The external-magnetic-path portion 24 is positioned outside the spiral wiring line 11. In other words, in the magnetic layer 20, the external-magnetic-path portion 24 is a portion that is sandwiched between the first magnetic layer 21 and the second magnetic layer 22 while being positioned outside the spiral wiring line 11. The internal-magnetic-path portion 23 and the external-magnetic-path portion 24 are connected to the first magnetic layer 21 and the second magnetic layer 22. As described above, the magnetic layer 20 forms a closed magnetic circuit with respect to the spiral wiring line 11.

As illustrated in FIG. 2 and FIG. 3, the magnetic layer 20, that is, the first magnetic layer 21, the second magnetic layer 22, the internal-magnetic-path portion 23, and the external-magnetic-path portion 24, are each include the base resin 72, which has the voids 71, and the metal magnetic powder 73 and the non-magnetic powder 74, which are contained in the base resin 72. Note that, in the inductor component 1 according to the present embodiment, although all of the first magnetic layer 21, the second magnetic layer 22, the internal-magnetic-path portion 23, and the external-magnetic-path portion 24 are made of the same material, they may be made of different materials.

As illustrated in FIG. 1 and FIG. 2, the insulator 31 has an electrical insulating property. The insulator 31 is disposed so as to be positioned between the first magnetic layer 21 and the second magnetic layer 22 and between the magnetic layer 20 and the spiral wiring line 11. In the present embodiment, the insulator 31 is disposed so as to be positioned between the first magnetic layer 21 and the spiral wiring line 11, between the second magnetic layer 22 and the spiral wiring line 11, between the internal-magnetic-path portion 23 and the spiral wiring line 11, and between the external-magnetic-path portion 24 and the spiral wiring line 11. In addition, the insulator 31 is in contact with the upper, lower, and lateral sides of the spiral wiring line 11 and covers the surface of the spiral wiring line 11. The insulator 31 ensures the insulation between portions of the spiral wiring line 11. Furthermore, the first magnetic layer 21 is in contact with the lower side of the insulator 31 (in the Z-axis direction), and the second magnetic layer 22 is in contact with the upper side of the insulator 31 (in the Z-axis direction). The surface of the insulator 31 is covered with the magnetic layer 20.

The insulator 31 is made of a non-magnetic insulating material. In the present embodiment, the insulator 31 is made of an insulating resin material including an inorganic filler and an organic resin material. Note that, in FIG. 1, although the magnetic layer 20 and the insulator 31 are illustrated as transparent, the magnetic layer 20 and the insulator 31 may be transparent, translucent, or opaque. Alternatively, the magnetic layer 20 and the insulator 31 may be colored.

For example, a resin containing silica (silicon dioxide ($SiO_2$)) powder can be used as a material of the insulator 31. However, the insulator 31 does not need to include silica powder. In addition, although the resin included in the insulator 31 may be any insulating resin, it is preferable that the insulator 31 include at least one of an epoxy-based resin, an acrylic resin, a phenolic resin, a polyimide-based resin, and a liquid crystal polymer-based resin.

The vertical wiring lines 41 to 43 are made of an electrically conductive material. Each of the vertical wiring lines 41 to 43 extends through the multilayer body 2 in the lamination direction of the multilayer body 2 from the spiral wiring line 11 to a surface of the multilayer body 2. Note that the above surfaces of the multilayer body 2 are the surfaces of the multilayer body 2 that face the outside of the inductor component 1. In the present embodiment, the surfaces of the multilayer body 2 are surfaces of the magnetic layer 20 that face the outside of the inductor component 1.

Each of the vertical wiring lines 41 to 43 extends from the spiral wiring line 11 in the Z-axis direction and extends through the first magnetic layer 21 or the second magnetic layer 22. The first vertical wiring line 41 includes a first via conductor 41*a* that extends upward from the upper surface of the inner periphery end 11*a* of the spiral wiring line 11 so as to extend through the insulator 31 in the Z-axis direction and a first columnar wiring line 41*b* that extends upward from the first via conductor 41*a* so as to extend through the second magnetic layer 22 in the Z-axis direction. The second vertical wiring line 42 includes a second via conductor 42*a* that extends upward from the upper surface of the outer periphery end 11*b* of the spiral wiring line 11 so as to extend through the insulator 31 in the Z-axis direction and a second columnar wiring line 42*b* that extends upward from the second via conductor 42*a* so as to extend through the second magnetic layer 22 in the Z-axis direction. The third vertical wiring line 43 includes a third via conductor 43*a* that extends downward from the lower surface of the outer periphery end 11*b* of the spiral wiring line 11 so as to extend through the insulator 31 in the Z-axis direction and a third columnar wiring line 43*b* that extends downward from the third via conductor 43*a* so as to extend through the first magnetic layer 21 in the Z-axis direction. The vertical wiring line 42 and the vertical wiring line 43 are positioned so as to face each other with the spiral wiring line 11 interposed therebetween in the Z-axis direction.

For example, a low-resistance metal such as copper, silver, or gold can be used as a material of the vertical wiring lines 41 to 43 (the via conductors 41*a* to 43*a* and the columnar wiring lines 41*b* to 43*b*). Preferably, a conductor made of copper or a copper compound is used as the material of the vertical wiring lines 41 to 43. In this case, the manufacturing costs of the vertical wiring lines 41 to 43 can be reduced, and the direct-current resistance of the vertical wiring lines 41 to 43 can be reduced. In addition, it is preferable that the vertical wiring lines 41 to 43 be formed of copper plating that is formed by the SAP. In this case, the low-resistance vertical wiring lines 41 to 43 can be obtained at low cost. Note that the vertical wiring lines 41 to 43 may be formed by, for example, a plating method other than the SAP, or by a sputtering method, a deposition method, or an application method.

The external terminals 51 to 53 are made of an electrically conductive material. Each of the external terminals 51 to 53 is formed on one of main surfaces of the multilayer body 2. The external terminal 51 is disposed on an exposed surface 41*c* of the vertical wiring line 41 that is exposed at one of the main surfaces of the multilayer body 2. The external terminal 52 is disposed on an exposed surface 42*c* of the vertical wiring line 42 that is exposed at one of the main surfaces of the multilayer body 2. The external terminal 53 is disposed on an exposed surface 43*c* of the vertical wiring line 43 that is exposed at one of the main surfaces of the multilayer body 2.

Note that the "main surfaces" of the multilayer body 2 are two of the surfaces of the multilayer body 2 that face the outside of the inductor component 1, the two surfaces being end surfaces that oppose each other in the lamination direction of the multilayer body 2. In the present embodiment, the multilayer body 2 has the two main surfaces. In other words, the two main surfaces of the multilayer body 2 are the lower surface of the first magnetic layer 21 and the upper surface of the second magnetic layer 22. In addition, in the case where the vertical wiring lines 41 to 43 are exposed at the main surfaces of the multilayer body 2, the term "expose" is not limited to complete exposure of the vertical wiring lines 41 to 43 to the outside of the inductor component 1 may be any exposure of the vertical wiring lines 41 to 43 as long as they are exposed through the multilayer body 2. In other words, the term "expose" also includes the case where the vertical wiring lines 41 to 43 are exposed through the multilayer body 2 to another member. Thus, for example, the exposed surfaces 41*c* to 43*c* of the vertical wiring lines 41 to 43 may be covered with other members such as insulating coating films (e.g., the coating films 61, which will be described later) or electrodes (e.g., the external terminals 51 to 53).

The first external terminal 51 is disposed on the upper surface of the second magnetic layer 22 and covers an end surface of the first vertical wiring line 41, which is exposed at the upper surface of the second magnetic layer 22, that is, the first external terminal 51 covers the upper end surface of the first columnar wiring line 41*b* and the exposed surface 41*c*. The second external terminal 52 is disposed on the upper surface of the second magnetic layer 22 and covers an end surface of the second vertical wiring line 42, which is exposed at the upper surface of the second magnetic layer 22, that is, the second external terminal 52 covers the upper end surface of the second columnar wiring line 42*b* and the exposed surface 42*c*. The second external terminal 53 is disposed on the lower surface of the first magnetic layer 21 and covers an end surface of the third vertical wiring line 43, which is exposed at the lower surface of the first magnetic layer 21, that is, the second external terminal 53 covers the lower end surface of the third columnar wiring line 43*b* and the exposed surface 43*c*. The second external terminal 52 and the third external terminal 53 are positioned so as to face each other with the spiral wiring line 11 interposed therebetween in the Z-axis direction.

In the inductor component 1 according to the present embodiment, when viewed in the Z-axis direction, the area of each of the external terminals 51 to 53, which cover the exposed surface 41*c* to 43*c* of the vertical wiring lines 41 to 43 (end surfaces of the columnar wiring lines 41*b* to 43*b*), is larger than the area of each of the vertical wiring lines 41 to 43. Note that, when the inductor component 1 is viewed in the Z-axis direction, the area of each of the external terminals 51 to 53 may be equal to or smaller than the area of each of the vertical wiring lines 41 to 43.

For example, a low-resistance metal such as copper, silver, or gold can be used as a material of the external terminals 51 to 53. Preferably, a conductor made of copper or a copper compound is used as the material of the external terminals 51 to 53. In this case, the manufacturing costs of the external terminals 51 to 53 can be reduced, and the direct-current resistance of the external terminals 51 to 53 can be reduced. Note that, by using a conductor having copper as a main material as the materials of the spiral wiring line 11, the vertical wiring lines 41 to 43, and the external terminals 51 to 53, the joint strength and the electrical conductivity between the spiral wiring line 11 and the vertical wiring lines 41 to 43 and between the vertical wiring lines 41 to 43 and the external terminals 51 to 53 can be improved. It is preferable that the external terminals 51 to 53 be formed of copper plating that is formed by the SAP. In this case, the low-resistance external terminals 51 to 53 can be obtained at low cost. Note that the external terminals 51 to 53 may be formed by, for example, a plating method other than the SAP, or by a sputtering method, a deposition method, or an application method.

It is preferable that each of the external terminals 51 to 53 be subjected to a rustproofing treatment. Here, the rustproofing treatment refers to formation of a coating film by using nickel (Ni), gold, tin (Sn), or the like. As a result, copper leaching by solder or formation of rust can be suppressed, and thus, the mount reliability of the inductor component 1 can be improved.

Note that the vertical wiring lines 41 to 43 and the external terminals 51 to 53 may be formed only on the first magnetic layer 21 or only on the second magnetic layer 22. In addition, a dummy terminal serving as an external terminal that is not electrically connected to the spiral wiring line 11 may be provided on the surface of the first magnetic layer 21 or on the surface of the second magnetic layer 22. A dummy terminal is electrically conductive, and thus, it has a high thermal conductivity. Consequently, the heat-dissipation performance in the inductor component 1 can be improved, and thus, the reliability of the inductor component 1 can be improved (the inductor component 1 can have a high environmental resistance).

As illustrated in FIG. 2, the coating films 61 are made of a non-magnetic insulating material. The coating films 61 cover the lower surface of the first magnetic layer 21 and the upper surface of the second magnetic layer 22. Note that the coating films 61 are not illustrated in FIG. 1. The coating film 61 covering the lower surface of the first magnetic layer 21 covers a region of the lower surface of the first magnetic layer 21 excluding the third external terminal 53 such that the lower end surface of the third external terminal 53 is exposed. The coating film 61 covering the upper surface of the second magnetic layer 22 covers a region of the upper surface of the second magnetic layer 22 excluding the first external terminal 51 and the second external terminal 52 such that the upper end surface of the first external terminal 51 and the upper end surface of the second external terminal 52 are exposed.

In the inductor component 1 according to the present embodiment, each of the surfaces of the external terminals 51 and 52 is located outside the surface of the second magnetic layer 22 in the Z-axis direction, and the surface of the external terminal 53 is located outside the surface of the first magnetic layer 21 in the Z-axis direction. More specifically, since each of the external terminals 51 to 53 is embedded in one of the coating films 61, the surfaces of the external terminals 51 and 52 are not on the same plane as the surface of the second magnetic layer 22, and the surface of the external terminal 53 is not on the same plane as the surface of the first magnetic layer 21. Note that the positional relationship between the surface of the second magnetic layer 22 and each of the surfaces of the external terminals 51 and 52 and the positional relationship between the surface of the first magnetic layer 21 and the surface of the external terminal 53 can be set independently, and thus, the degree of freedom in the thickness of each of the external terminals 51 to 53 can be increased. In the inductor component 1, the heightwise position of each of the surfaces of the external terminals 51 to 53 can be adjusted, and thus, for example, in the case where the inductor component 1 is embedded in a substrate, the heightwise positions of the surfaces of the external terminals 51 to 53 can be adjusted to the heightwise position of an external terminal of another embedded component. Accordingly, by using the inductor component 1 having the above-described configuration, a laser focusing step that is performed when a via is formed in a substrate can be streamlined, and thus, the efficiency of manufacturing the substrate can be improved.

The coating films 61 are formed of, for example, a photosensitive resist, a solder resist, a dry film resist, or the like that is made of an organic insulating resin such as an epoxy-based resin, a phenolic resin, or a polyimide-based resin. Note that the material of the coating films 61 may be the same as or different from the material of the insulator 31.

It is preferable that the thickness (the length in the Z-axis direction) of the inductor component 1 according to the present embodiment be 0.5 mm or smaller. For example, the thickness of the inductor component 1 according to the present embodiment is 0.200 mm. In addition, the chip size of the inductor component 1 according to the present embodiment is, for example, 2.0 mm×2.0 mm. In the inductor component 1 according to the present embodiment, the spiral wiring line 11 has, for example, a wiring width of 210 μm, an interwiring space of 10 μm, and a wiring thickness of 70 μm. Note that the thickness and the chip size of the inductor component 1 and the wiring width, the interwiring space, and the wiring thickness of the spiral wiring line 11 are not limited to these and may be suitably changed.

In addition, although the inductor component 1 according to the present embodiment is a surface mount component that is mounted onto a surface of a substrate, the inductor component 1 may be an embedded-type component that is configured to be installed by being buried in a hole formed in a substrate. The inductor component 1 can also be used as a component for three-dimensional connection that is installed in an integrated circuit (IC) package such as a semiconductor package. For example, the inductor component 1 can be mounted on a surface of a substrate included in an IC package or can be installed by being embedded in a hole formed in the substrate.

Note that, in the present embodiment, although the external terminal 53 is provided on the first magnetic layer 21, in the case where the external terminal 53 is not provided on the first magnetic layer 21, the coating film 61 covering the surface of the first magnetic layer 21 may be omitted.

The magnetic layer 20 will now be described in detail.

As illustrated in FIG. 2 and FIG. 3, the base resin 72 included in the first magnetic layer 21, the second magnetic layer 22, the internal-magnetic-path portion 23, and the external-magnetic-path portion 24, that is, the base resin 72 included in the magnetic layer 20, may be an insulating resin and preferably contains at least one of an epoxy-based resin and an acrylic resin. Note that the insulator 31, which is in contact with the first magnetic layer 21 and the second magnetic layer 22, may be made of an insulating resin and preferably contains at least one of the resins contained in the base resin 72.

Although it is not necessary for particles of the metal magnetic powder 73 contained in the base resin 72 to have a spherical shape, it is preferable that the particles of the metal magnetic powder 73 each have a spherical shape. Note that, in the present specification, the term "spherical shape" includes a spherical shape a portion of which is missed and a deformed spherical shape in addition to a spherical shape having a constant diameter.

It is preferable that the average particle diameter of the metal magnetic powder 73 be 1 μm or more and 5 μm or less (i.e., from 1 μm to 5 μm). Note that, in the present specification, the average particle diameter of the metal magnetic powder 73 is measured by a laser diffraction/scattering method while the metal magnetic powder 73 is in a raw material state. A particle diameter that corresponds to 50% of an integrated value in particle size distribution obtained by the laser diffraction/scattering method is set as the average particle diameter of the metal magnetic powder 73. In addition, in the state of the inductor component 1, the average particle diameter of the metal magnetic powder 73 is measured by using a scanning electron microscope (SEM) image of a cross section passing through the center of a measurement target that is one of the first magnetic layer 21, the second magnetic layer 22, the internal-magnetic-path portion 23, and the external-magnetic-path portion 24. More specifically, in a SEM image at a magnification at which 15 or more particles of the metal magnetic powder 73 can be observed, the area of each particle of the metal magnetic powder 73 is measured, and the equivalent circle diameters of the particles are calculated from a formula of $\{4/\pi\times(\text{area})\}^{(1/2)}$. Then, the arithmetic average value of the equivalent circle diameters is set as the average particle diameter of the metal magnetic powder 73. Note that if the outlines of the particles of the metal magnetic powder 73 are unclear in the SEM image, image processing may be performed. Also, the average particle diameter of the metal magnetic powder 73 may be less than 1 μm or more than 5 μm.

The metal magnetic powder 73 has electrical conductivity. For example, magnetic metal containing iron (Fe) can be used as a material of the metal magnetic powder 73. Iron may be contained alone in the metal magnetic powder 73 or may be contained in the metal magnetic powder 73 as an alloy containing iron. Examples of the material of the metal magnetic powder 73 containing iron include an iron-silicon (Si)-based alloy such as iron-silicon-chrome (Cr) alloy, an iron-cobalt (Co)-based alloy, an iron-based alloy such as permalloy (NiFe), or an amorphous alloy of these can be used. In the case where the metal magnetic powder 73 includes iron, it is preferable that the metal magnetic powder 73 contains 1 wt % or more and 5 wt % or less (i.e., from 1 wt % to 5 wt %) of chrome (Cr). In the present embodiment, the metal magnetic powder 73 is an iron-silicon-chrome alloy powder.

Although it is not necessary for particles of the non-magnetic powder 74 contained in the base resin 72 to have a spherical shape, it is preferable that the particles of the non-magnetic powder 74 each have a spherical shape. In addition, it is preferable that the average particle diameter of the non-magnetic powder 74 be smaller than the average particle diameter of the metal magnetic powder 73. Note that, in the present specification, the average particle diameter of the non-magnetic powder 74 is measured by the laser diffraction/scattering method while the non-magnetic powder 74 is in a raw material state. A particle diameter that corresponds to 50% of an integrated value in particle size distribution obtained by the laser diffraction/scattering method is set to the average particle diameter of the non-magnetic powder 74. In addition, in the state of the inductor component 1, the average particle diameter of the non-magnetic powder 74 is measured by using a SEM image of a cross section passing through the center of a measurement target that is one of the first magnetic layer 21, the second magnetic layer 22, the internal-magnetic-path portion 23, and the external-magnetic-path portion 24. More specifically, in a SEM image at a magnification at which 15 or more particles of the non-magnetic powder 74 can be observed, the area of each particle of the non-magnetic powder 74 is measured, and the equivalent circle diameters of the particles are calculated from the formula of $\{4/\pi\times(\text{area})\}^{(1/2)}$. Then, the arithmetic average value of the equivalent circle diameters is set as the average particle diameter of the non-magnetic powder 74. Note that if the outlines of the particles of the non-magnetic powder 74 are unclear in the SEM image, image processing may be performed. The average particle diameter of the non-magnetic powder 74 is not necessarily smaller than the average particle diameter of the metal magnetic powder 73.

Silica can be used as a material of the non-magnetic powder 74. The average particle diameter of the nonmagnetic powder 74 in the case where silica is used as the material of the non-magnetic powder 74 is about 0.5 μm. Note that the material of the non-magnetic powder 74 is not limited to silica, and for example, barium sulfate ($BaSO_4$) or boron nitride (BN) can also be used. The non-magnetic powder 74 serves as an insulator in the base resin 72.

The voids 71 of the base resin 72 can be easily observed by creating a cross section of the inductor component 1 by a grinding method and then etching the cross section in a depth direction by using a focused ion beam (FIB) or the like without performing resin sealing.

There is a particle of the metal magnetic powder 73 included in the magnetic layer 20 that is in contact with at least one of the voids 71 and with the non-magnetic powder 74. Note that, in the case where the metal magnetic powder 73 is provided with an insulating coating, it is preferable that the non-magnetic powder 74 and the voids 71 be in contact with the metal magnetic powder 73 via the insulating coating (i.e., be in contact with the insulating coating of the metal magnetic powder 73). In addition, it is preferable that a plurality of particles of the metal magnetic powder 73 that are each in contact with at least one of the voids 71 and with the non-magnetic powder 74 be present in each of the first magnetic layer 21 and the second magnetic layer 22. Furthermore, it is preferable that the internal-magnetic-path portion 23 and the external-magnetic-path portion 24 also include the metal magnetic powder 73 that is in contact with at least one of the voids 71 and with the non-magnetic powder 74. In addition, in the lamination direction of the multilayer body 2 (the Z-axis direction in FIG. 2), it is preferable that the inductor component 1 include a plurality of particles of the metal magnetic powder 73 that are each in contact with at least one of the voids 71 and with the non-magnetic powder 74. However, it is not necessary for the inductor component 1 to include a plurality of particles of the metal magnetic powder 73 that are each in contact with at least one of the voids 71 and with the non-magnetic powder 74 in the lamination direction of the multilayer body 2. In addition, each of the first magnetic layer 21 and the second magnetic layer 22 does not need to include a plurality of particles of the metal magnetic powder 73 that are each in contact with at least one of the voids 71 and with the non-magnetic powder 74.

Figure 4:
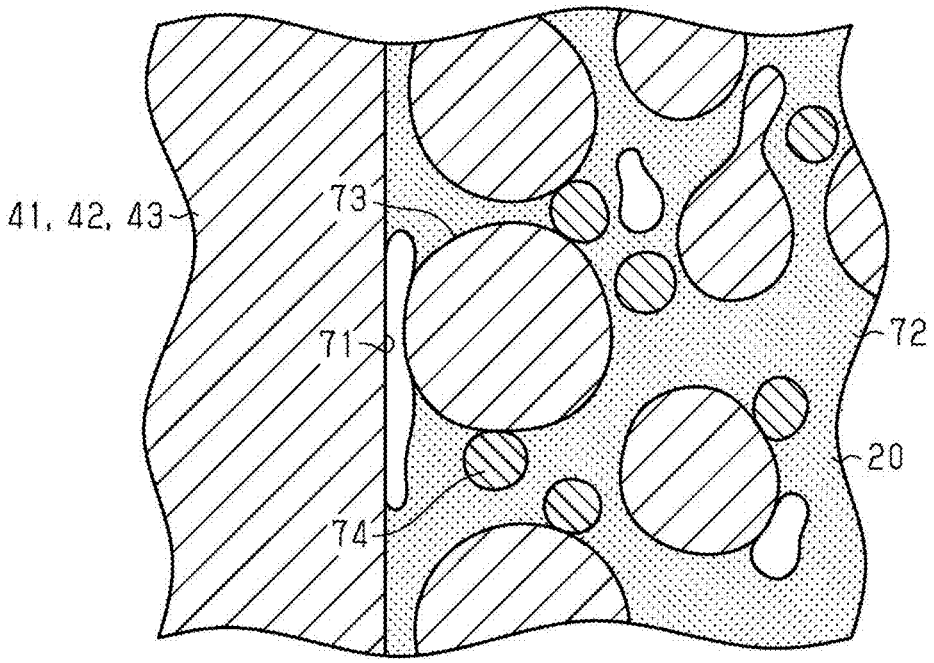
FIG. 4 is an enlarged sectional view of the inductor component according to the first embodiment.

As illustrated in FIG. 4, in the inductor component 1, it is preferable that at least one of the voids 71 that is in contact with the metal magnetic powder 73 also be in contact with one of the vertical wiring lines 41 to 43. However, it is not necessary for the void 71 that is in contact with the metal magnetic powder 73 to be in contact with one of the vertical wiring lines 41 to 43.

The metal magnetic powder 73 that is in contact with at least one of the voids 71 and with the non-magnetic powder 74 can be observed in an image obtained by using a SEM. In order to obtain a SEM image, first, a cross section of a center portion of the inductor component 1 is created by a grinding method. After that, an image of a portion of the magnetic layer 20 in the cross section of the inductor component 1 is obtained by using a SEM. Then, in the portion of the magnetic layer 20 in the cross section of the inductor component 1, three or more images are captured at different positions in the vertical direction (the Z-axis direction) at a magnification of 10,000 times. It is confirmed that, by checking the captured SEM images, a plurality of particles of the metal magnetic powder 73 that are each in contact with at least one of the voids 71 and with the non-magnetic powder 74 are present both in the first magnetic layer 21 and the second magnetic layer 22. Note that the magnification of the SEM is not limited to 10,000 times and may be appropriately changed in accordance with the sizes of particles of the metal magnetic powder 73. However, a magnification at which 15 or more particles of the metal magnetic powder 73 can be observed is preferable.

Figure 5:
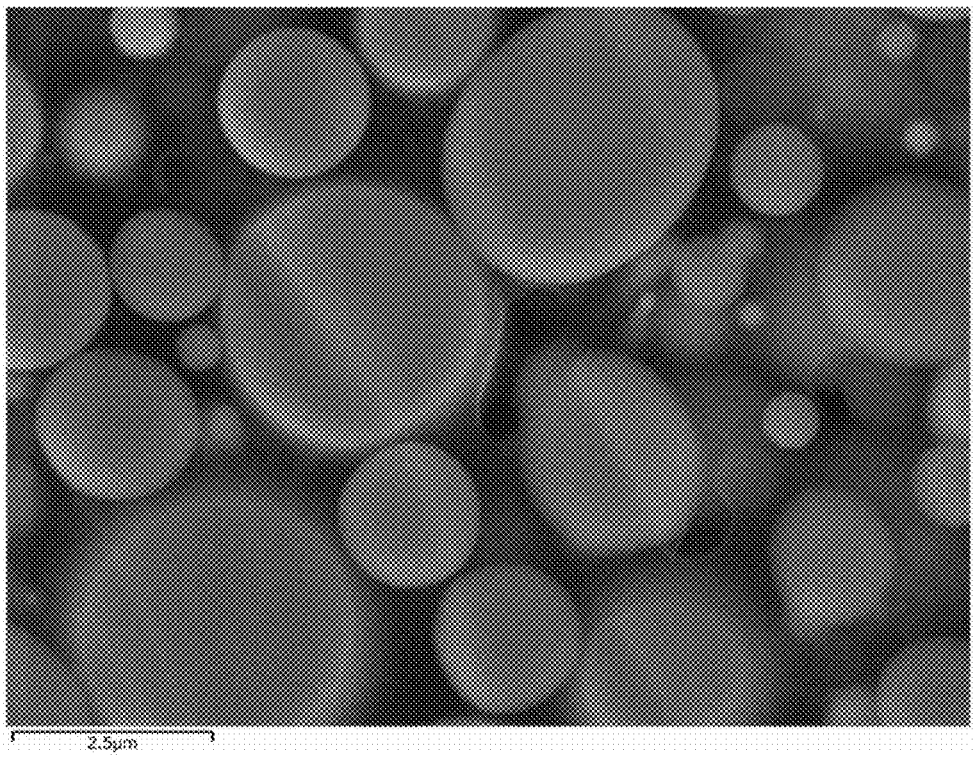
FIG. 5 is a photograph of a cross section of the inductor component according to the first embodiment.
Figure 6:
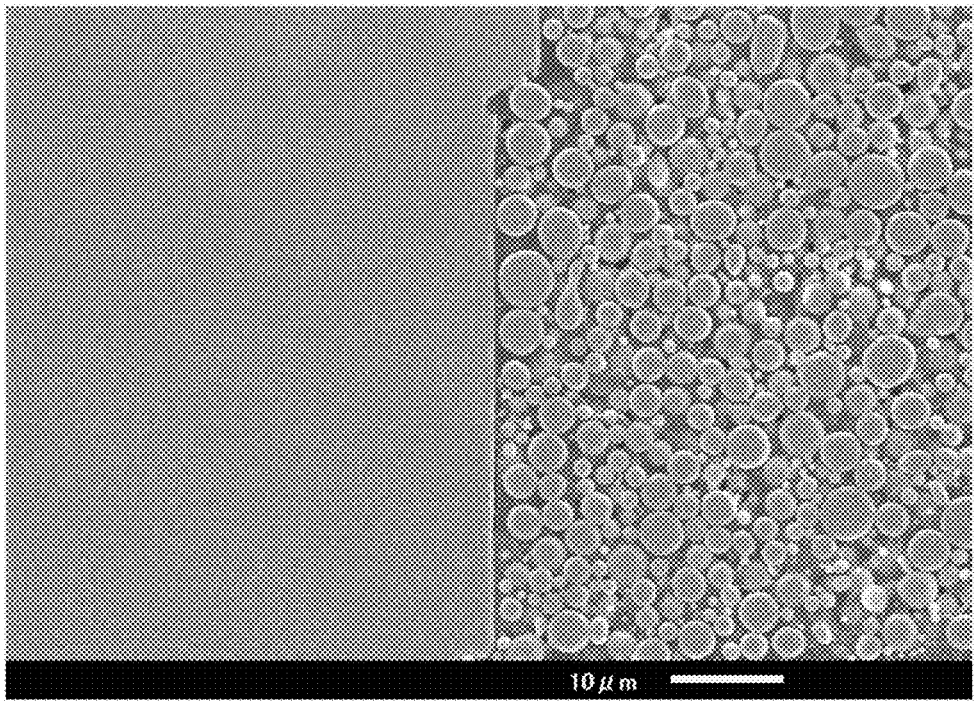
FIG. 6 is a photograph of a cross section of the inductor component according to the first embodiment.

FIG. 5 and FIG. 6 each illustrate a SEM image of the inductor component 1 obtained by the above-mentioned method. In FIG. 6, it can be confirmed that some of the voids 71 are in contact with the vertical wiring line 41 and the metal magnetic powder 73.

As illustrated in FIG. 3, it is preferable that the particle diameter of the non-magnetic powder 74 in contact with the metal magnetic powder 73 be one-third or less of the particle diameter of the metal magnetic powder 73, which is in contact with the non-magnetic powder 74. The particle diameter of the non-magnetic powder 74 in contact with the metal magnetic powder 73 and the particle diameter of the metal magnetic powder 73, which is in contact with the non-magnetic powder 74, are measured by using a SEM image of a cross section passing through the center of a measurement target that is one of the first magnetic layer 21, the second magnetic layer 22, the internal magnetic path 23, and the external magnetic path 24. More specifically, in a SEM image, the area of a particle of the non-magnetic powder 74 that is in contact with the metal magnetic powder 73 is measured, and the equivalent circle diameter of the particle that is calculated from the formula of $\{4/\pi\times(\text{area})\}^{(1/2)}$ using the measured area is set as the diameter of the particle of the non-magnetic powder 74. In addition, in the SEM image, the area of a particle of the metal magnetic powder 73 that is in contact with the non-magnetic powder 74 is measured, and the equivalent circle diameter of the particle that is calculated from the formula of $\{4/\pi\times(\text{area})\}^{(1/2)}$ using the measured area is set as the diameter of the particle of the metal magnetic powder 73. Note that, if the outline of the particle of the metal magnetic powder 73 and the outline of the particle of the non-magnetic powder 74 are unclear in the SEM image, image processing may be performed. The particle diameter of the non-magnetic powder 74 that is in contact with the metal magnetic powder 73 is not necessarily one-third or less of the particle diameter of the metal magnetic powder 73.

It is preferable that the cross-sectional shape of at least one of the voids 71 that is in contact with the metal magnetic powder 73 have different lengths in two orthogonal directions. FIG. 3 illustrates lengths in two orthogonal directions L1 and L2 in the cross-sectional shape of a void 71*a* that is in contact with the metal magnetic powder 73. For example, the direction L1 is the longitudinal direction in the cross-sectional shape of the void 71*a*. The direction L2 is a direction perpendicular to the direction L1 in the cross-sectional shape of the void 71*a*. A length D1 in the direction L1 and a length D2 in the direction L2 are different from each other. Note that the direction L1 does not need to be the longitudinal direction and may be any direction in the cross-sectional shape of at least one of the voids 71 that is in contact with the metal magnetic powder 73. Examples of a shape that is the cross-sectional shape of at least one of the voids 71 that is in contact with the metal magnetic powder 73 and that has different lengths in two orthogonal directions include an elliptical shape, a gourd-like shape, a comma-like shape, a boomerang-like shape, a track-like shape (i.e., a racetrack-like shape).

Regarding at least one of the voids 71 that is in contact with the metal magnetic powder 73 and that has a shape having different lengths in two orthogonal directions in its cross section, it is further preferable that the major axis of the void 71 be longer than the equivalent circle diameter of the void 71 in the cross section. Note that at least one of the voids 71 that is in contact with the metal magnetic powder 73 does not need to have different lengths in two orthogonal directions in its cross-sectional shape.

The cross-sectional shape of at least one of the voids 71 that is in contact with the metal magnetic powder 73 can be observed in a SEM image of a cross section passing through the center of a measurement target that is one of the first magnetic layer 21, the second magnetic layer 22, the internal magnetic path 23, and the external magnetic path 24. In addition, the equivalent circle diameter of the void 71 is calculated by measuring the area of the void 71 in the SEM image and then using the formula of $\{4/\pi\times(\text{area})\}^{(1/2)}$ with the measured area.

It is preferable that the diameter of at least one of the voids 71 that is in contact with the metal magnetic powder 73 be smaller than the particle diameter of the metal magnetic powder 73, which is in contact with the void 71. More specifically, it is preferable that the minor axis of the void 71 that is in contact with the metal magnetic powder 73 be smaller than the equivalent circle diameter of the metal magnetic powder 73. It is further preferable that the equivalent circle diameter of the void 71 that is in contact with the metal magnetic powder 73 be smaller than the equivalent circle diameter of the metal magnetic powder 73. Note that the diameter of the void 71 that is in contact with the metal magnetic powder 73 does not need to be smaller than the particle diameter of the metal magnetic powder 73, which is in contact with the void 71.

The diameter of the void 71 that is in contact with the metal magnetic powder 73 is measured by using a SEM image of a cross section passing through the center of a measurement target that is one of the first magnetic layer 21, the second magnetic layer 22, the internal magnetic path 23, and the external magnetic path 24. In addition, the particle diameter of the metal magnetic powder 73, which is in contact with the void 71, is measured by using the same SEM image. More specifically, in the SEM image, the area of the particle of the metal magnetic powder 73 that is in contact with the void 71 is measured, and the equivalent circle diameter that is calculated from the formula of $\{4/\pi\times(\text{area})\}^{(1/2)}$ using the measured area is set as the diameter of the particle of the metal magnetic powder 73. In addition, the equivalent circle diameter of the void 71 is calculated by measuring the area of the void 71 in the same SEM image and then using the formula of $\{4/\pi\times(\text{area})\}^{(1/2)}$ with the measured area. Note that if the outline of the particle of the metal magnetic powder 73 and the outline of the void 71 are unclear in the SEM image, image processing may be performed.

Advantageous Effects

Advantageous effects of the present embodiment will now be described.

The magnetic layer 20 includes the base resin 72, the metal magnetic powder 73, and the non-magnetic powder 74. The base resin 72 has the voids 71, and the metal magnetic powder 73 and the non-magnetic powder 74 are contained in the base resin 72. There is a particle of the metal magnetic powder 73 that is in contact with at least one of the voids 71 and with the non-magnetic powder 74. In the present embodiment, a plurality of particles of the metal magnetic powder 73 are each in contact with at least one of the voids 71 and with the non-magnetic powder 74. Thus, reduction in the stress generated in the inductor component 1 and improvement of the insulating property can be achieved by at least one of the voids 71 that is in contact with the metal magnetic powder 73 and the non-magnetic powder 74 that is in contact with the metal magnetic powder 73.

By using silica as the material of the non-magnetic powder 74, the insulation between the particles of the metal magnetic powder 73 in the magnetic layer 20 can be improved.

In addition, as a result of particles of the metal magnetic powder 73 and particles of the non-magnetic powder 74 each having a spherical shape, even if the amounts of the metal magnetic powder 73 and the non-magnetic powder 74 contained in the base resin 72 (hereinafter sometimes referred to as "the filling amounts of the metal magnetic powder 73 and the non-magnetic powder 74") are increased, the metal magnetic powder 73 and the non-magnetic powder 74 may easily be uniformly dispersed throughout the base resin 72.

By using the metal magnetic powder 73 including iron, the magnetic saturation characteristics of the magnetic layer 20 can be improved.

In addition, if the metal magnetic powder 73 contains 1 wt % or more and 5 wt % or less (i.e., from 1 wt % to 5 wt %) of chrome, the chrome is oxidized in the metal magnetic powder 73 and forms a passivated layer, and as a result, oxidation of the metal magnetic powder 73 is suppressed. In the present embodiment, since the metal magnetic powder 73 is an iron-silicon-chrome alloy powder, the metal magnetic powder 73 includes iron. When iron is oxidized, its color is changed to, for example, reddish brown. However, since the metal magnetic powder 73 of the present embodiment includes chrome, oxidation of iron is suppressed, so that the inductor component 1 can be suppressed from becoming discolored. Note that chrome is white, and an oxide film that forms a passivated layer is colorless and transparent. Therefore, the inductor component 1 can be suppressed from becoming discolored even when chrome forms a passivated layer.

By setting the average particle diameter of the metal magnetic powder 73 to 1 μm or more and 5 μm or less (i.e., from 1 μm to 5 μm), the direct-current superposition characteristics can be improved. In addition, an eddy-current loss (an iron loss) can be kept small. Since the average particle diameter of the non-magnetic powder 74 is smaller than the average particle diameter of the metal magnetic powder 73, the probability that the non-magnetic powder 74 will hinder an increase in the filling amount of the metal magnetic powder 73 is reduced. In addition, the non-magnetic powder 74 is likely to be positioned between the particles of the metal magnetic powder 73.

In general, when the average particle diameter of metal magnetic powder is smaller than 1 μm, it is difficult to uniformly disperse the metal magnetic powder throughout a base resin because the weight of the metal magnetic powder is light. In addition, when the average particle diameter of metal magnetic powder is smaller than 1 μm, the surface area of the metal magnetic powder in a base resin is large, and thus, it is difficult to increase the amount of the metal magnetic powder that is contained in the base resin, and as a result, it becomes difficult to reduce the magnetic reluctance. In contrast, in the inductor component 1 according to the present embodiment, since the average particle size of the metal magnetic powder 73 is 1 μm or more, the metal magnetic powder 73 may easily be uniformly dispersed throughout the base resin 72, and the amount of the metal magnetic powder 73 contained in the base resin 72 can be easily increased.

The particle diameter of the non-magnetic powder 74 that is in contact with the metal magnetic powder 73 is one-third or less of the particle diameter of the metal magnetic powder 73, which is in contact with the non-magnetic powder 74. Thus, the probability that the non-magnetic powder 74 will hinder an increase in the filling amount of the metal magnetic powder 73 is further reduced. In addition, the non-magnetic powder 74 is more likely to be positioned between the particles of the metal magnetic powder 73.

When there are a plurality of particles of the metal magnetic powder 73 that are each in contact with at least one of the voids 71 and with the non-magnetic powder 74 in the lamination direction of the multilayer body 2, there are a plurality of particles of the metal magnetic powder 73 that are each in contact with at least one of the voids 71 and with the non-magnetic powder 74 in the magnetic layer 20. Thus, further reduction in the stress generated in the inductor component 1 and further improvement of the insulating property can be achieved by the voids 71 and the non-magnetic powder 74 that are in contact with the metal magnetic powder 73.

Since the base resin 72 contains at least one of an epoxy-based resin and an acrylic resin, the insulating property of the magnetic layer 20 can be improved. In addition, reduction in the stress generated in the inductor component 1 can be also achieved by the base resin 72.

Each of the voids 71 may have a non-spherical shape, and thus, the voids 71 can be arranged along the surfaces of particles of the metal magnetic powder 73. If the voids 71 each of which has a shape having different lengths in two orthogonal directions in its cross-sectional shape are arranged along the surfaces of particles of the metal magnetic powder 73, the voids 71 can be brought into contact with wider areas of the surfaces of the particles of the metal magnetic powder 73.

Since the diameter of at least one of the voids 71 that is in contact with the metal magnetic powder 73 is smaller than the particle diameter of the metal magnetic powder 73, which is in contact with the void 71, the probability that the non-magnetic powder 74 will hinder an increase in the filling amount of the metal magnetic powder 73 is reduced. In addition, the probability that the mechanical strength of the magnetic layer 20 will decrease due to the voids 71 can be reduced.

Since the inductor component 1 includes the insulator 31 that covers the spiral wiring line 11 in the multilayer body 2, the insulation between portions of the spiral wiring line 11 and the insulation between the spiral wiring line 11 and an electrically conductive portion that is positioned in the vicinity of the spiral wiring line 11 can be improved. For example, when the interwiring space of the spiral wiring line 11 is extremely narrow, the probability that a path in which an electrical short-circuit occurs through the metal magnetic powder 73 will be generated between portions of the spiral wiring line 11 can be eliminated, and the reliability of the inductor component 1 can be improved.

The inductor component 1 includes the vertical wiring lines 41 to 43, so that the spiral wiring line 11 can be easily connected to an external circuit. In addition, in the present embodiment, the particles of the metal magnetic powder 73 and the particles of the non-magnetic powder 74 each have a spherical shape. Thus, in the manufacture of the inductor component 1, the base resin 72 containing the metal magnetic powder 73 and the non-magnetic powder 74 can be easily press-fitted into the space enclosed by the spiral wiring line 11 (i.e., the space where the internal-magnetic-path portion 23 is formed), the space outside the spiral wiring line 11 (i.e., the space where the external-magnetic-path portion 24 is formed), and the spaces around the vertical wiring lines 41 to 43.

As described above, the inductor component 1 of the present embodiment can be used as an embedded-type component that is configured to be installed by being buried in a hole formed in a substrate or as a component for three-dimensional connection that is installed in an IC package. In the inductor component 1, each of the vertical wiring lines 41 to 43 is directly extended from the spiral wiring line 11 in the Z-axis direction. In this case, the spiral wiring line 11 is extended to the upper surface or the lower surface of the inductor component 1 at the shortest distance, and in three-dimensional mounting in which a wiring line of a substrate is connected to the upper surface or the lower surface of the inductor component 1, unnecessary wire routing can be reduced. Therefore, the inductor component 1 has a configuration that is sufficiently compatible with three-dimensional mounting, so that the degree of freedom in circuit design can be improved.

In the inductor component 1, since no wiring line is extended from the spiral wiring line 11 in the lateral direction (i.e., in a direction perpendicular to the lamination direction), the area of the inductor component 1 when viewed in the Z-axis direction, that is, the mounting area of the inductor component 1 can be reduced. Therefore, both in surface mounting and in three-dimensional mounting, the mounting area of the inductor component 1 can be reduced and the degree of freedom in circuit design can be improved.

In the inductor component 1, each of the vertical wiring lines 41 to 43 extends through the multilayer body 2 in the lamination direction of the multilayer body 2 from the spiral wiring line 11 to the corresponding surface of the multilayer body 2 and extends in a direction perpendicular to the plane S1 on which the spiral wiring line 11 is wound. In this case, in the vertical wiring lines 41 to 43, a current does not flow in the direction along the plane S1 on which the spiral wiring line 11 is wound, but flows in the Z-axis direction.

Here, as the inductor component 1 is reduced in size, the magnetic layer 20 becomes smaller in size proportionately. In this case, the magnetic flux density in the internal-magnetic-path portion 23 increases, and thus, magnetic saturation is likely to occur. However, the magnetic flux generated by the current that flows in the Z-axis direction in the vertical wiring lines 41 to 43 does not pass through the internal-magnetic-path portion 23, and thus, the influence on the magnetic saturation characteristics, that is, the direct-current superposition characteristics, can be reduced. In contrast, in the case where a wiring line is extended from the spiral wiring line 11 to the side (in the direction along the plane S1 on which the spiral wiring line 11 is wound) by using an extending portion, a portion of the magnetic flux generated by the current flowing through the extending portion passes through the internal-magnetic-path portion 23 or the external-magnetic-path portion 24, and thus, there is a concern of the influence on the magnetic saturation characteristics, that is, the direct-current superposition characteristics.

Since each of the vertical wiring lines 41 to 43 extends through the first magnetic layer 21 or the second magnetic layer 22 in the lamination direction, the sizes of openings that are formed in the magnetic layer 20 when the vertical wiring lines 41 to 43 are extended from the spiral wiring line 11 can be reduced, and thus, a closed magnetic circuit structure can be easily obtained. As a result, noise propagation toward the substrate can be suppressed.

Since at least one of the voids 71 that is in contact with the metal magnetic powder 73 is also in contact with one of the vertical wiring lines 41 to 43, the insulation between one of the vertical wiring lines 41 to 43 and the metal magnetic powder 73 can be improved by the void 71 that is in contact with the one of the vertical wiring lines 41 to 43 and with the metal magnetic powder 73.

The inductor component 1 includes the external terminals 51 to 53, each of which is formed on one of the main surfaces of the multilayer body 2. The external terminal 51 is disposed on the exposed surface 41*c* of the vertical wiring line 41 that is exposed at one of the main surfaces of the multilayer body 2. The external terminal 52 is disposed on the exposed surface 42*c* of the vertical wiring line 42 that is exposed at one of the main surfaces of the multilayer body 2. The external terminal 53 is disposed on the exposed surface 43*c* of the vertical wiring line 43 that is exposed at one of the main surfaces of the multilayer body 2. Thus, when viewed in the Z-axis direction, the area of each of the external terminals 51 to 53, which cover the exposed surface 41*c* to 43*c* of the vertical wiring lines 41 to 43, can be larger than the area of each of the vertical wiring lines 41 to 43. With this configuration, the joining area at the time of mounting the inductor component 1 increases, and thus, the mount reliability of the inductor component 1 can be improved. In addition, when the inductor component 1 is mounted onto the substrate, an alignment margin can be ensured for the position at which a wiring line of a substrate and the inductor component 1 are joined to each other, and this also facilitates improvement in the mount reliability of the inductor component 1. Furthermore, since the mount reliability can be improved regardless of the volumes of the columnar wiring lines 41*b* to 43*b*, a decrease in the volume of the first magnetic layer 21 or the second magnetic layer 22 can be suppressed by reducing the cross-sectional areas of the columnar wiring lines 41*b* to 43*b* when viewed in the Z-axis direction, and a decrease in the characteristics of the inductor component 1 can be suppressed.

The insulator 31 includes at least one of an epoxy-based resin, an acrylic resin, a phenolic resin, a polyimide-based resin, and a liquid crystal polymer-based resin and also includes at least one of the resins contained in the base resin 72. Thus, the insulation between portions of the spiral wiring line 11 and the insulation between the spiral wiring line 11 and an electrically conductive portion that is positioned in the vicinity of the spiral wiring line 11 can be improved. In addition, the resins contained in the base resin 72, which is included in the magnetic layer 20, and the resins contained in the insulator 31 have a common resin. Consequently, distortion that is generated between the magnetic layer 20 and the insulator 31 can be kept small.

In the inductor component 1 of the present embodiment, the average particle diameter of the metal magnetic powder 73 is 1 μm or more and 5 μm or less (i.e., from 1 μm to 5 μm), which is small. In other words, the particles of the metal magnetic powder 73 are small. Thus, when the thickness of the inductor component 1 is adjusted by adjusting the thickness of the magnetic layer 20 (the thicknesses of the first magnetic layer 21 and the second magnetic layer 22), the adjustment is less likely to be affected by shedding of particles of the metal magnetic powder 73 from the base resin 72, which is included in the magnetic layer 20. In other words, with or without shedding of particles of the metal magnetic powder 73, the thickness of the magnetic layer 20 can be adjusted.

(Manufacturing Method)

A method of manufacturing the inductor component 1 will now be described.

Figure 7:
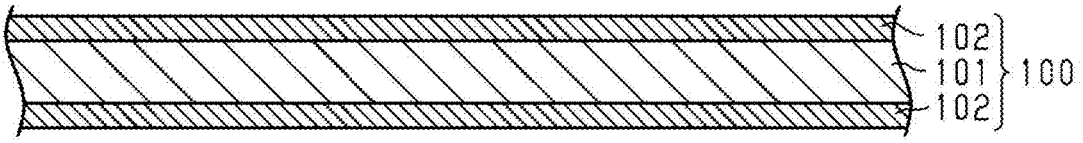
FIG. 7 is a diagram illustrating a process of manufacturing the inductor component according to the first embodiment.

As illustrated in FIG. 7, a dummy core substrate 100 is prepared. The dummy core substrate 100 includes an insulating substrate 101 and base metal layers 102 that are provided on the two surfaces of the insulating substrate 101. In the present embodiment, the insulating substrate 101 is a glass-epoxy substrate, and each of the base metal layers 102 is a copper foil. The thickness of the dummy core substrate 100 does not affect the thickness of the inductor component 1, and thus, the dummy core substrate 100 may have a suitable thickness that is easy to handle in view of, for example, warpage during processing.

Figure 8:
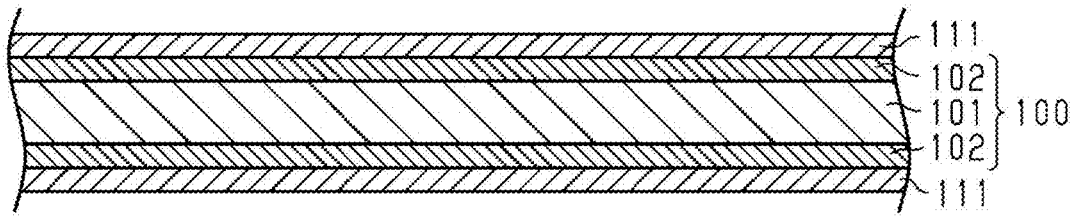
FIG. 8 is a diagram illustrating a process of manufacturing the inductor component according to the first embodiment.

Next, as illustrated in FIG. 8, dummy metal layers 111 are each bonded to a surface of one of the base metal layers 102. In the present embodiment, each of the dummy metal layers 111 is a copper foil. The dummy metal layers 111 are bonded to smooth surfaces of the base metal layers 102, and thus, the bonding strength between each of the dummy metal layers 111 and the corresponding base metal layer 102 can be reduced. Thus, the dummy core substrate 100 can be easily separated from the dummy metal layers 111 in a subsequent process. It is preferable that each of the base metal layers 102 of the dummy core substrate 100 and the corresponding dummy metal layer 111 be bonded to each other with an adhesive having a low viscosity. In addition, in order to reduce the bonding strength between each of the base metal layers 102 and the corresponding dummy metal layer 111, it is preferable that the bonding surfaces of the base metal layers 102 and the dummy metal layers 111 be glossy surfaces.

Figure 9:
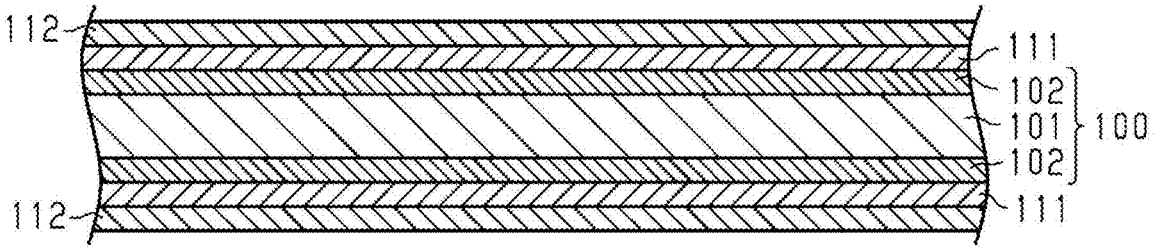
FIG. 9 is a diagram illustrating a process of manufacturing the inductor component according to the first embodiment.

Subsequently, as illustrated in FIG. 9, insulating layers 112 are each formed onto one of the dummy metal layers 111. Each of the insulating layers 112 is thermocompression-bonded to the corresponding dummy metal layer 111 and then thermally-cured by using a vacuum laminator, a press machine, or the like.

Figure 10:
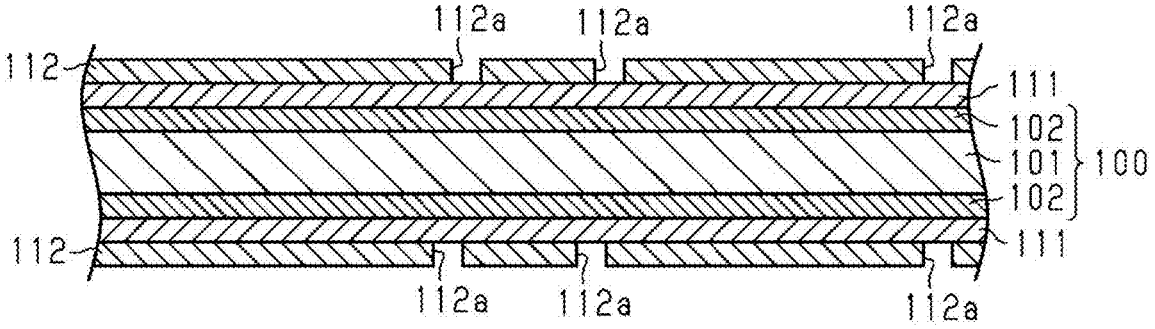
FIG. 10 is a diagram illustrating a process of manufacturing the inductor component according to the first embodiment.

Then, as illustrated in FIG. 10, cavities 112*a* are formed in the insulating layers 112 by laser processing or the like.

Figure 11:
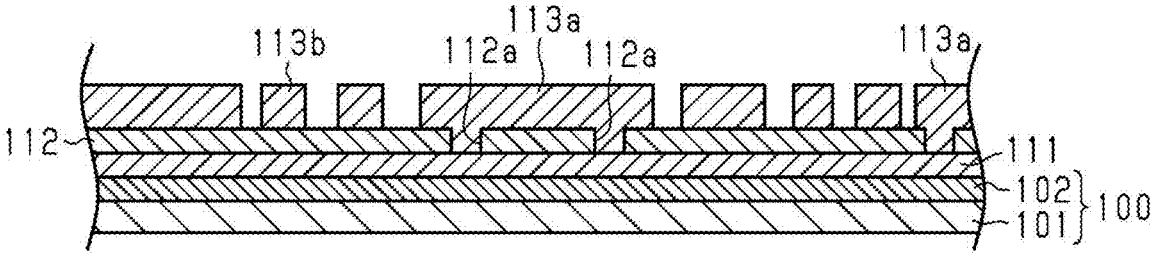
FIG. 11 is a diagram illustrating a process of manufacturing the inductor component according to the first embodiment.

After that, as illustrated in FIG. 11, a dummy copper portion 113*a* and a spiral wiring line 113*b* are formed on one of the insulating layers 112. More specifically, a power-supply film (not illustrated) for the SAP is formed on the insulating layer 112 by electroless plating, sputtering, evaporation, or the like. After the power-supply film has been formed, a layer made of a photosensitive resist is formed on the power-supply film by applying or attaching the photosensitive resist to the power-supply film. Then, cavities of the photosensitive resist layer are formed by photolithography at positions where wiring patterns are to be formed. Subsequently, the dummy copper portion 113*a* and a metal wiring line that corresponds to the spiral wiring line 113*b* are formed in the cavities of the photosensitive resist layer. After the metal wiring line has been formed, the photosensitive resist is separated and removed by using a chemical solution, and then, the power-supply film is removed by etching. After that, additional copper electrolytic plating is performed by using the metal wiring line as a power supplying portion, and as a result, the spiral wiring line 113*b* with a narrow space is obtained. In addition, copper is injected into the cavities 112*a* by the SAP.

Figure 12:
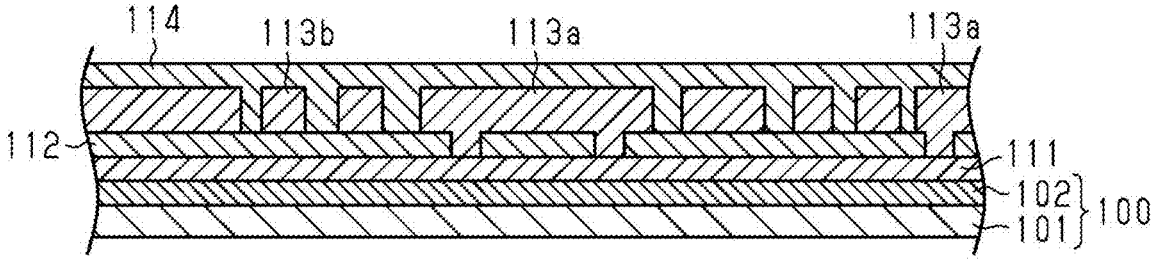
FIG. 12 is a diagram illustrating a process of manufacturing the inductor component according to the first embodiment.

Next, as illustrated in FIG. 12, the dummy copper portion 113*a* and the spiral wiring line 113*b* are covered with an insulating layer 114. The insulating layer 114 is thermocompression-bonded and then thermally-cured by using a vacuum laminator, a press machine, or the like.

Figure 13:
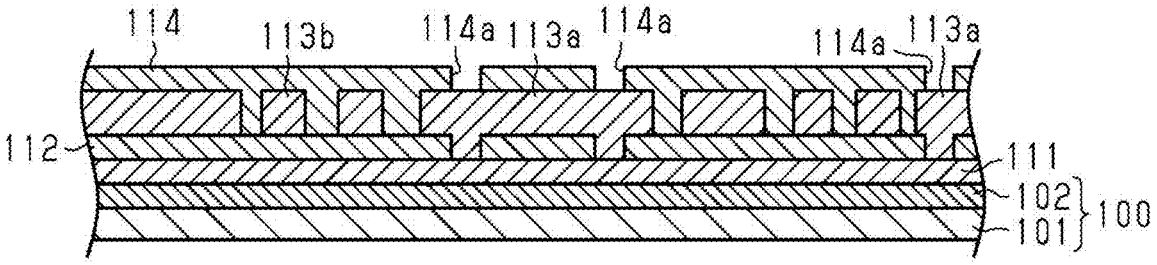
FIG. 13 is a diagram illustrating a process of manufacturing the inductor component according to the first embodiment.

Subsequently, as illustrated in FIG. 13, cavities 114*a* are formed in the insulating layer 114 by laser processing or the like.

Figure 14:
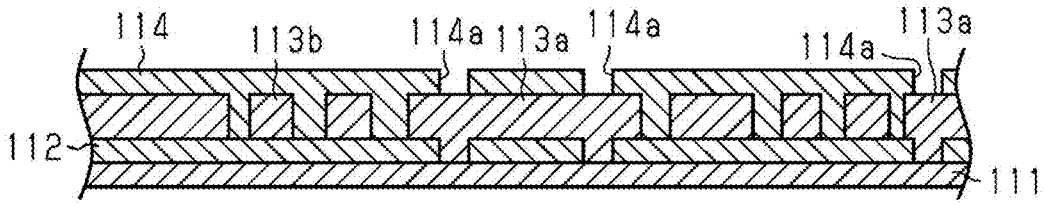
FIG. 14 is a diagram illustrating a process of manufacturing the inductor component according to the first embodiment.

After that, as illustrated in FIG. 14, the dummy core substrate 100 is separated from the dummy metal layer 111.

Figure 15:
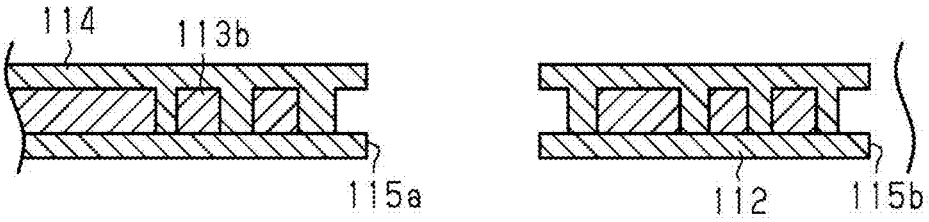
FIG. 15 is a diagram illustrating a process of manufacturing the inductor component according to the first embodiment.

Then, as illustrated in FIG. 15, the dummy metal layer 111 is removed by etching or the like. In addition, the dummy copper portion 113*a* is removed by etching or the like. As a result, a hole 115*a* that corresponds to the internal-magnetic-path portion 23 and a hole 115*b* that corresponds to the external-magnetic-path portion 24 are formed.

Figure 16:
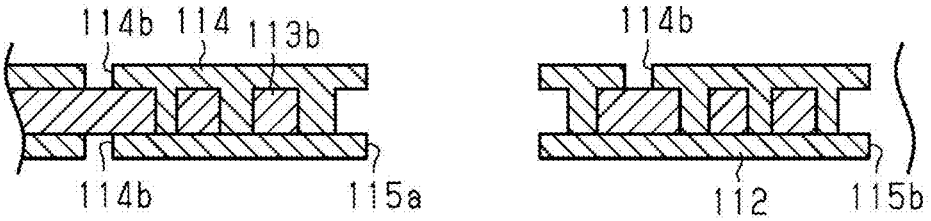
FIG. 16 is a diagram illustrating a process of manufacturing the inductor component according to the first embodiment.

After that, as illustrated in FIG. 16, cavities 114*b* are formed in the insulating layers 112 and 114 by laser processing or the like.

Figure 17:
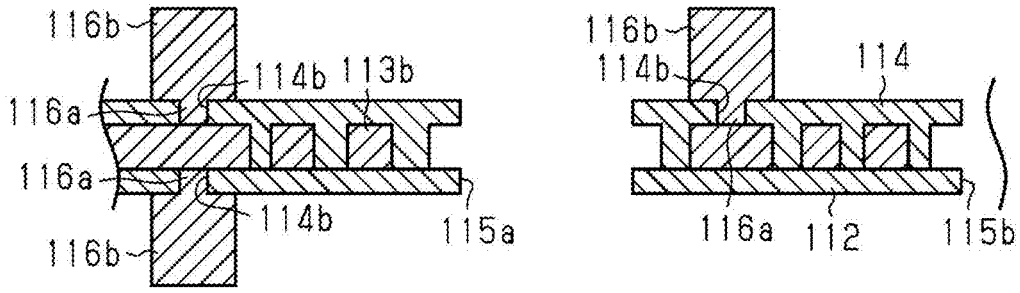
FIG. 17 is a diagram illustrating a process of manufacturing the inductor component according to the first embodiment.

Subsequently, by using the SAP, via conductors 116*a* are formed by filling the cavities 114*b* with copper, and then columnar wiring lines 116*b* are formed on the insulating layers 112 and 114 as illustrated in FIG. 17.

Figure 18:
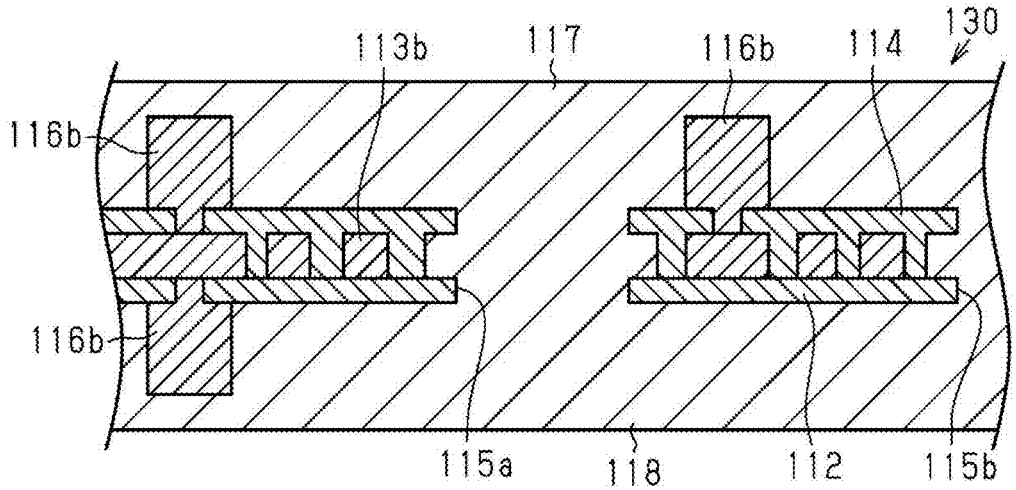
FIG. 18 is a diagram illustrating a process of manufacturing the inductor component according to the first embodiment.

Next, as illustrated in FIG. 18, the spiral wiring line 113*b*, the insulating layers 112 and 114, and the columnar wiring lines 116*b* are covered with a magnetic layer 117, so that an inductor substrate 130 is formed. The magnetic layer 117 is made of a magnetic material 118 that includes the base resin 72 having the voids 71, the metal magnetic powder 73, and the non-magnetic powder 74 (see FIG. 3). The magnetic material 118 (the magnetic layer 117) is thermocompression-bonded and then thermally-cured by using a vacuum laminator, a press machine, or the like. In this case, the magnetic material 118 is also injected into the holes 115*a* and 115*b*.

Note that when the magnetic layer 117 is formed by using the magnetic material 118, the voids 71 are formed in the base resin 72. If application of pressure for thermocompression bonding of the magnetic material 118 is started before the melt viscosity of the magnetic material 118 decreases to the lowest degree, the flowability of the magnetic material 118 is reduced, and thus, the magnetic material 118 is injected into the holes 115*a* and 115*b* while containing air. After that, the magnetic material 118 is heated, and when the melt viscosity of the magnetic material 118 further decreases, the magnetic material 118 starts to harden in a state where the holes 115*a* and 115*b* have been sufficiently filled with the magnetic material 118 and in a state where the magnetic material 118 contains the air as mentioned above. As a result, the base resin 72 having the voids 71 can be formed.

Note that the method of forming the voids 71 is not limited to the above. For example, an additive having a low molecular weight may be added to the magnetic material 118, and then, the additive may be caused to decompose when the magnetic material 118 hardens, so that the voids 71 can be formed at the positions where the additive is present. Alternatively, the voids 71 may be formed by a combination of the above-described methods or by a different method.

Figure 19:
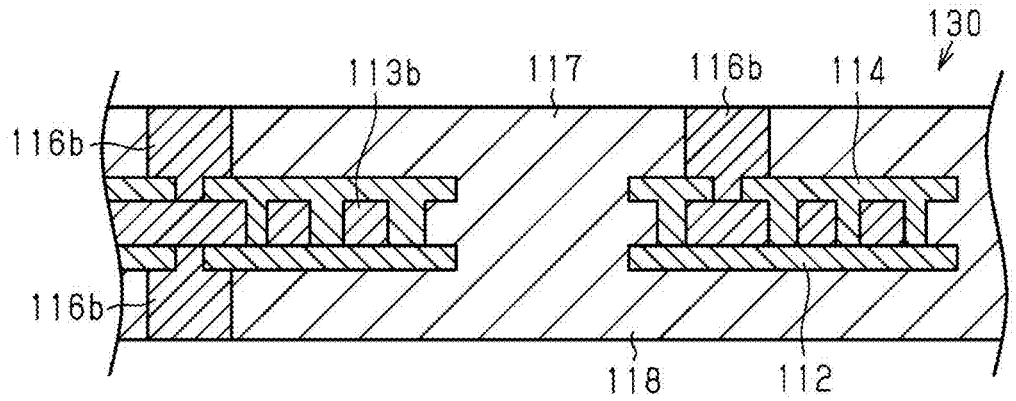
FIG. 19 is a diagram illustrating a process of manufacturing the inductor component according to the first embodiment.

Next, as illustrated in FIG. 19, the magnetic material 118 provided on the top of the inductor substrate 130 and the magnetic material 118 provided on the bottom of the inductor substrate 130 are each formed into a thin layer by a grinding method. In this case, portions of the columnar wiring lines 116*b* are exposed as a result of grinding the magnetic material 118, so that the exposed portions of the columnar wiring lines 116*b* are formed on the same plane as the magnetic material 118. Note that, by grinding the magnetic material 118 until the magnetic material 118 has a thickness that is sufficient to obtain an inductance, a reduction in the thickness of the inductor component 1 can be achieved.

Figure 20:
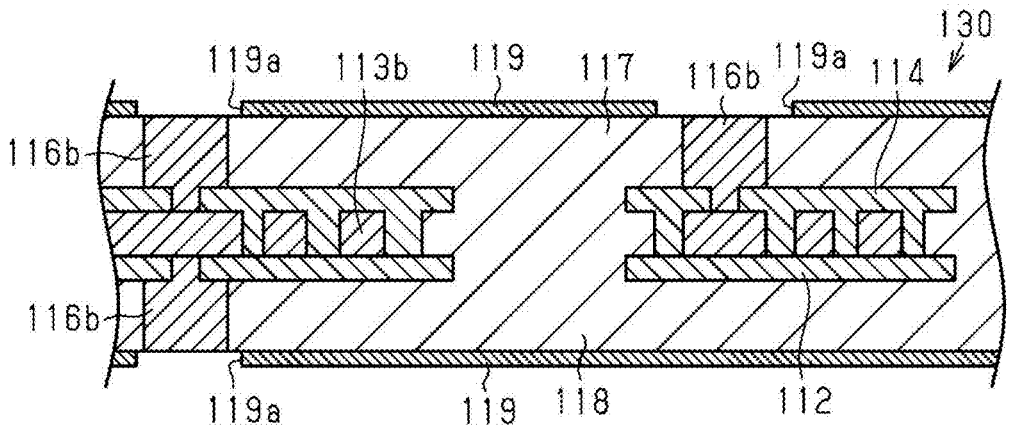
FIG. 20 is a diagram illustrating a process of manufacturing the inductor component according to the first embodiment.

Next, as illustrated in FIG. 20, coating films 119 that are made of a non-magnetic insulating material are formed on the two surfaces of the magnetic layer 117 by a printing method. The formed coating films 119 have cavities 119*a*. External terminals 121 are to be formed in these cavities 119*a*. In the present embodiment, although a printing method is used to form the coating films 119 having the cavities 119*a*, the cavities 119*a* may be formed by a photolithography method.

Figure 21:
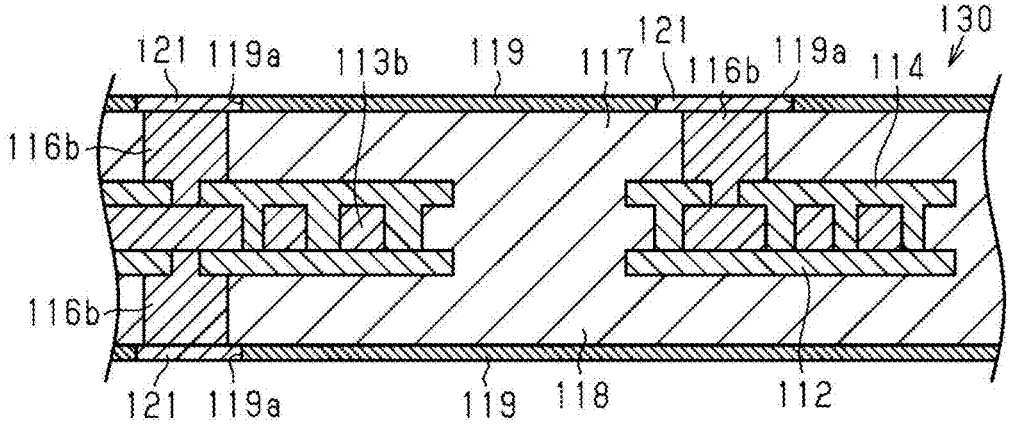
FIG. 21 is a diagram illustrating a process of manufacturing the inductor component according to the first embodiment.

Next, as illustrated in FIG. 21, the external terminals 121 are formed. The external terminals 121 are formed as metal films made of copper, nickel, gold, tin, or the like by, for example, electroless plating or electrolytic plating.

Figure 22:
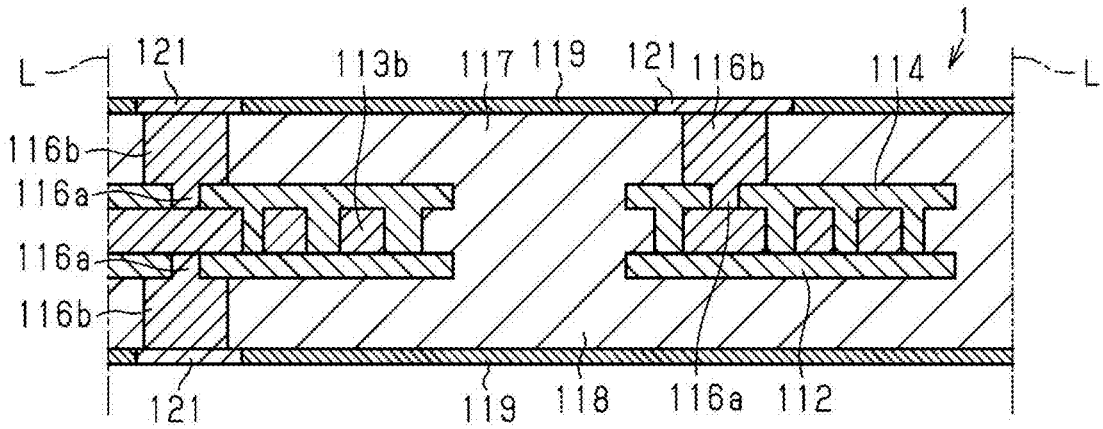
FIG. 22 is a diagram illustrating a process of manufacturing the inductor component according to the first embodiment.

After that, by cutting the inductor substrate 130 with a dicing machine along one-dot chain lines L as illustrated in FIG. 22, the inductor component 1 that is illustrated in FIG. 2 is obtained. Note that the spiral wiring line 113*b* illustrated in FIG. 22 corresponds to the spiral wiring line 11 illustrated in FIG. 2. The insulating layers 112 and 114 illustrated in FIG. 22 correspond to the insulator 31 illustrated in FIG. 2. The magnetic layer 117 illustrated in FIG. 22 corresponds to the magnetic layer 20 illustrated in FIG. 2, that is, the first magnetic layer 21, the second magnetic layer 22, the internal-magnetic-path portion 23, and the external-magnetic-path portion 24. The three via conductors 116*a* illustrated in FIG. 22 correspond to the via conductors 41*a* to 43*a* illustrated in FIG. 2, and the three columnar wiring lines 116*b* illustrated in FIG. 22 correspond to the columnar wiring lines 41*b* to 43*b* illustrated in FIG. 2. The three external terminals 121 illustrated in FIG. 22 correspond to the external terminals 51 to 53 illustrated in FIG. 2.

As described above, unlike the related art, the spiral wiring line 11 is not formed on a printed circuit board in the inductor component 1 according to the present embodiment. Accordingly, the inductor component 1 does not include such a printed circuit board on which a spiral wiring line is to be formed, and thus, this is advantageous for a reduction in the size of the inductor component 1. Note that, in the case of a configuration in which a spiral wiring line is formed on a printed circuit board as in the related art, it is difficult to omit the board.

Although not illustrated in FIG. 11 and the subsequent drawings, the inductor substrate 130 may be formed on each of the two surfaces of the dummy core substrate 100. In this case, the productivity can be improved.

Advantageous effects of the present embodiment will now be described.

(1-1) The inductor component 1 includes the multilayer body 2, which includes the magnetic layer 20, and the spiral wiring line 11, which is disposed in the multilayer body 2 and which is an example of an inductor wiring line. The magnetic layer 20 includes the base resin 72, the metal magnetic powder 73, and the non-magnetic powder 74. The base resin 72 has the voids 71, and the metal magnetic powder 73 and the non-magnetic powder 74 are contained in the base resin 72. There is a particle of the metal magnetic powder 73 that is in contact with at least one of the voids 71 and with the non-magnetic powder 74.

According to the above aspect, reduction in the stress generated in the inductor component 1 and improvement of the insulating property can be achieved by at least one of the voids 71 that is in contact with the metal magnetic powder 73 and the non-magnetic powder 74 that is in contact with the metal magnetic powder 73. In addition, since reduction in the stress generated in the inductor component 1 and improvement of the insulating property can be facilitated with the structure of the magnetic layer 20, an additional configuration such as insulator coating does not need to be provided. Therefore, reduction in the manufacturing costs of the inductor component 1 and reductions in the size and height of the inductor component 1 can be achieved.

(1-2) the non-magnetic powder 74 is made of silica. By using silica as the material of the non-magnetic powder 74 as mentioned above, the insulation between the particles of the metal magnetic powder 73 in the magnetic layer 20 can be improved. In addition, by using silica, which is inexpensive, as the material of the non-magnetic powder 74, the manufacturing costs of the inductor component 1 can be reduced, and the inductor component 1 that is favorable in terms of mass production can be obtained.

(1-3) Particles of the metal magnetic powder 73 and particles of the non-magnetic powder 74 each have a spherical shape. Thus, even if the amounts of the metal magnetic powder 73 and the non-magnetic powder 74 contained in the base resin 72 are increased, the metal magnetic powder 73 and the non-magnetic powder 74 may easily be uniformly dispersed throughout the base resin 72. In addition, the magnetic layer 20, that is, the base resin 72 containing the metal magnetic powder 73 and the non-magnetic powder 74, may easily be press-fitted into a narrow space such as a space between portions of the spiral wiring line 11 (e.g., the space enclosed by the spiral wiring line 11 where the internal-magnetic-path portion 23 is formed).

(1-4) The metal magnetic powder 73 includes iron. Consequently, the magnetic saturation characteristics of the magnetic layer 20 can be improved.

(1-5) The metal magnetic powder 73 contains 1 wt % or more and 5 wt % or less (i.e., from 1 wt % to 5 wt %) of chrome. Thus, the chrome is oxidized in the metal magnetic powder 73 and forms a passivated layer, and as a result, oxidation of the metal magnetic powder 73 is suppressed. Therefore, the inductor component 1 that is capable of withstanding not only temperature changes but also a severe environment with high humidity can be obtained.

(1-6) The average particle diameter of the metal magnetic powder 73 is 1 μm or more and 5 μm or less (i.e., from 1 μm to 5 μm). The average particle diameter of the non-magnetic powder 74 is smaller than the average particle diameter of the metal magnetic powder 73.

By setting the average particle diameter of the metal magnetic powder 73 to 1 μm or more and 5 μm or less (i.e., from 1 μm to 5 μm), the direct-current superposition characteristics can be improved. In addition, by setting the average particle diameter of the metal magnetic powder 73 to 5 μm or less, an eddy-current loss (an iron loss) can be kept small.

Since the average particle diameter of the non-magnetic powder 74 is smaller than the average particle diameter of the metal magnetic powder 73, the probability that the non-magnetic powder 74 will hinder an increase in the filling amount of the metal magnetic powder 73 is reduced. Thus, the inductance can easily be improved by increasing the filling amount of the metal magnetic powder 73. In addition, since the non-magnetic powder 74 is likely to be positioned between the particles of the metal magnetic powder 73, even if the filling amount of the metal magnetic powder 73 increases, the particles of the metal magnetic powder 73 may be easily insulated from one another by the non-magnetic powder 74.

In general, when the average particle diameter of metal magnetic powder is smaller than 1 μm, it is difficult to uniformly disperse the metal magnetic powder throughout a base resin because the weight of the metal magnetic powder is light. In addition, when the average particle diameter of metal magnetic powder is smaller than 1 μm, the surface area of the metal magnetic powder in a base resin is large, so that it is difficult to increase the amount of the metal magnetic powder that is contained in the base resin, and as a result, it becomes difficult to reduce the magnetic reluctance. In contrast, in the inductor component 1 according to the present embodiment, since the average particle size of the metal magnetic powder 73 is 1 μm or more, the metal magnetic powder 73 may easily be uniformly dispersed throughout the base resin 72, and the magnetic reluctance can be reduced by increasing the amount of the metal magnetic powder 73 contained in the base resin 72.

(1-7) The particle diameter of the non-magnetic powder 74 that is in contact with the metal magnetic powder 73 is one-third or less of the particle diameter of the metal magnetic powder 73, which is in contact with the non-magnetic powder 74. Thus, the probability that the non-magnetic powder 74 will hinder an increase in the filling amount of the metal magnetic powder 73 is further reduced. In addition, since the non-magnetic powder 74 is more likely to be positioned between the particles of the metal magnetic powder 73, even if the filling amount of the metal magnetic powder 73 increases, the particles of the metal magnetic powder 73 may further easily be insulated from one another by the non-magnetic powder 74.

(1-8) In the lamination direction of the multilayer body 2, there are a plurality of particles of the metal magnetic powder 73 that are each in contact with at least one of the voids 71 and with the non-magnetic powder 74. Accordingly, a plurality of particles of the metal magnetic powder 73 that are in contact with at least one of the voids 71 and with the non-magnetic powder 74 are present both in the magnetic layer 20, and thus, the stress generated in the inductor component 1 can be further reduced, and the insulating property of the magnetic layer 20 can be further improved by the voids 71 and the non-magnetic powder 74 that are in contact with the metal magnetic powder 73.

(1-9) The base resin 72 contains at least one of an epoxy-based resin and an acrylic resin. Consequently, the insulating property of the magnetic layer 20 can be improved. In addition, reduction in the stress generated in the inductor component 1 can be achieved also by the base resin 72. Thus, the influence of stress can be further reduced, so that the mechanical strength of the inductor component 1 can be improved. As a result, even when the size and height of the inductor component 1 are reduced, decrease in reliability can be suppressed.

(1-10) The cross-sectional shape of at least one of the voids 71 that is in contact with the metal magnetic powder 73 has different lengths in two orthogonal directions. Since the void 71 may have a non-spherical shape, the void 71 can be arranged along the surface of a particle of the metal magnetic powder 73. If the void 71 that has a shape with different lengths in two orthogonal directions in its cross section is arranged along the surface of a particle of the metal magnetic powder 73, the void 71 can be brought into contact with a wider area of the surface of the particle of the metal magnetic powder 73. As a result, the insulation between the particle and an adjacent particle of the metal magnetic powder 73 can be improved by the void 71.

In the case where the major axis of the void 71 having a shape with different lengths in two orthogonal directions in its cross section is longer than the equivalent circle diameter of the void 71 in the cross section, the void 71 can be easily brought into contact with a wider area of the surface of a particle of the metal magnetic powder 73, the particle being in contact with the void 71. As a result, the insulation between the particle and an adjacent particle of the metal magnetic powder 73 can be further improved by the void 71.

(1-11) The diameter of at least one of the voids 71 that is in contact with the metal magnetic powder 73 is smaller than the particle diameter of the metal magnetic powder 73, which is in contact with the void 71. Thus, the probability that the non-magnetic powder 74 will hinder an increase in the filling amount of the metal magnetic powder 73 is reduced. In addition, the probability that the mechanical strength of the magnetic layer 20 will decrease due to the voids 71 can be reduced.

(1-12) The multilayer body 2 includes the non-magnetic insulator 31 that is in contact with the spiral wiring line 11, and the inductor component 1 includes the vertical wiring lines 41 to 43 each of which extends through the multilayer body 2 in the lamination direction of the multilayer body 2 from the spiral wiring line 11 to the corresponding surface of the multilayer body 2. As described above, as a result of the multilayer body 2 including the insulator 31 that is in contact with the spiral wiring line 11, the insulation between portions of the spiral wiring line 11 and the insulation between the spiral wiring line 11 and an electrically conductive portion that is positioned in the vicinity of the spiral wiring line 11 can be improved. In addition, as a result of the inductor component 1 including the vertical wiring lines 41 to 43, the spiral wiring line 11 and an external circuit can be easily connected to each other.

(1-13) At least one of the voids 71 that is in contact with the metal magnetic powder 73 is also in contact with one of the vertical wiring lines 41 to 43. Thus, the insulation between one of the vertical wiring lines 41 to 43 and the metal magnetic powder 73 can be improved by the void 71 that is in contact with the one of the vertical wiring lines 41 to 43 and with the metal magnetic powder 73. As a result, the insulation between one of the vertical wiring lines 41 to 43 and an electrically conductive portion that is provided in the vicinity of the one of the vertical wiring lines 41 to 43 can be improved.

(1-14) The inductor component 1 further includes the external terminals 51 to 53 each of which is formed on one of the main surfaces of the multilayer body 2. The external terminal 51 is disposed on the exposed surface 41*c* of the vertical wiring line 41 that is exposed at one of the main surfaces of the multilayer body 2. The external terminal 52 is disposed on the exposed surface 42*c* of the vertical wiring line 42 that is exposed at one of the main surfaces of the multilayer body 2. The external terminal 53 is disposed on the exposed surface 43*c* of the vertical wiring line 43 that is exposed at one of the main surfaces of the multilayer body 2. Therefore, the spiral wiring line 11 and an external circuit can further easily be connected to each other.

(1-15) The insulator 31 includes at least one of an epoxy-based resin, an acrylic resin, a phenolic resin, a polyimide-based resin, and a liquid crystal polymer-based resin and also includes at least one of the resins contained in the base resin 72. As described above, since the insulator 31 includes at least one of an epoxy-based resin, an acrylic resin, a phenolic resin, a polyimide-based resin, and a liquid crystal polymer-based resin, the insulation between portions of the spiral wiring line 11 and the insulation between the spiral wiring line 11 and an electrically conductive portion that is positioned in the vicinity of the spiral wiring line 11 can be improved. In addition, since the resins contained in the base resin 72, which is included in the magnetic layer 20, and the resins contained in the insulator 31 have a common resin, distortion that is generated in the inductor component 1 due to the resin included in the magnetic layer 20 and the insulator 31 can be kept small. As a result, generation of stress generated in the inductor component 1 can be suppressed.

(1-16) The thickness of the inductor component 1 is 0.5 mm or smaller. Since the average particle diameter of the metal magnetic powder 73 according to the present embodiment is 1 μm or more and 5 μm or less (i.e., from 1 μm to 5 μm), which is small, when the thickness of the inductor component 1 is adjusted by adjusting the thickness of the magnetic layer 20, the adjustment is less likely to be affected by shedding of particles of the metal magnetic powder 73 from the base resin 72. In other words, with or without shedding of particles of the metal magnetic powder 73, the thickness of the magnetic layer 20 can be adjusted. Therefore, the inductor component 1 whose thickness is further reduced to 0.5 mm or smaller can be obtained.

Second Embodiment

An inductor component according to a second embodiment will be described below.

Note that, in the second embodiment, the same components as in the above-described first embodiment or components that correspond to those in the above-described first embodiment are denoted by the same reference signs, and some or all of the descriptions thereof may sometimes be omitted.

Figure 23:
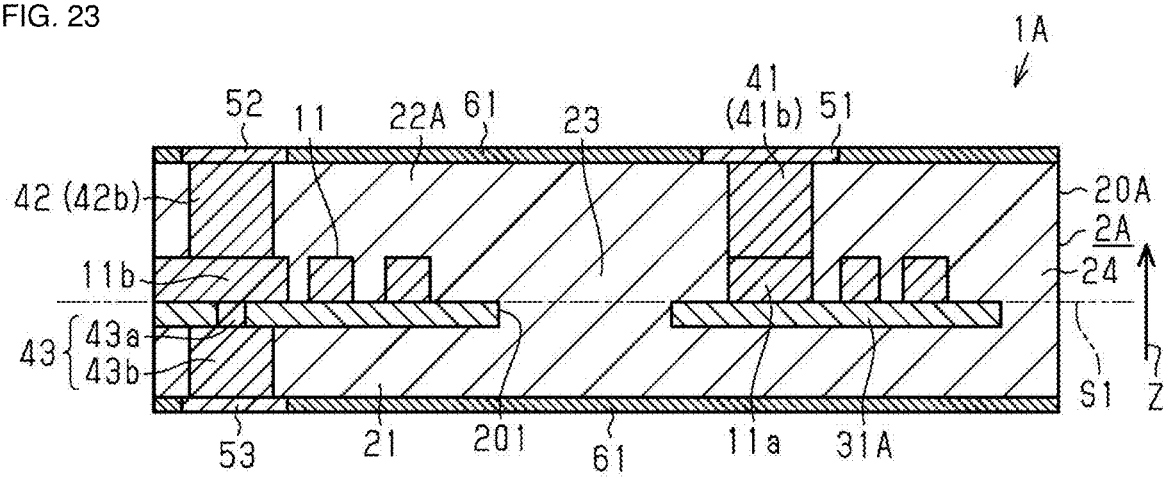
FIG. 23 is a sectional view of an inductor component according to a second embodiment.

The difference between an inductor component 1A of the second embodiment that is illustrated in FIG. 23 and the inductor component 1 of the above-described first embodiment is the configuration of the multilayer body. The inductor component 1A includes a multilayer body 2A instead of the multilayer body 2, which is included in the inductor component 1 of the first embodiment. The multilayer body 2A includes a magnetic layer 20A instead of the magnetic layer 20 of the first embodiment and includes an insulator 31A instead of the insulator 31 of the first embodiment. The magnetic layer 20A includes the first magnetic layer 21, a second magnetic layer 22A, the internal-magnetic-path portion 23, and the external-magnetic-path portion 24. The second magnetic layer 22A is included in the magnetic layer 20A instead of the second magnetic layer 22 of the first embodiment.

The insulator 31A is a non-magnetic member having an electrical insulating property. The insulator 31A is disposed so as to be positioned between the first magnetic layer 21 and the second magnetic layer 22A and between the first magnetic layer 21 and the spiral wiring line 11. The insulator 31A is in contact with the lower side of the spiral wiring line 11 (in the positive Z-axis direction), and the lower surface of the insulator 31A is covered with the first magnetic layer 21. An internal-magnetic-path hole 201 in which a portion (a lower end portion) of the internal-magnetic-path portion 23 is positioned is formed in a substantially central portion of the insulator 31A. The third via conductor 43*a* of the vertical wiring line 43 extends downward from the lower surface of the outer periphery end 11*b* of the spiral wiring line 11 so as to extend through the insulator 31A in the Z-axis direction. Note that, in the second embodiment, the material of the insulator 31A is similar to the material of the insulator 31 of the above-described first embodiment.

The second magnetic layer 22A covers the upper surface of the spiral wiring line 11 and is also disposed between portions of the spiral wiring line 11. In addition, the second magnetic layer 22A is in contact with the upper (in the negative Z-axis direction) and lateral sides of the spiral wiring line 11 and covers the surface of the spiral wiring line 11. In other words, the spiral wiring line 11 is exposed to the second magnetic layer 22A.

The first vertical wiring line 41 of the second embodiment does not include the first via conductor 41*a* and is formed of only the first columnar wiring line 41*b*. The first columnar wiring line 41*b* extends through the multilayer body 2A in the lamination direction of the multilayer body 2A (which is parallel to the Z-axis direction in FIG. 23) from the upper surface of the inner periphery end 11*a* of the spiral wiring line 11 to the upper surface of the multilayer body 2A. In other words, the first vertical wiring line 41 extends through the second magnetic layer 22A in the lamination direction of the multilayer body 2A. Similarly, the second vertical wiring line 42 of the second embodiment does not include the second via conductor 42*a* and is formed of only the second columnar wiring line 42*b*. The second columnar wiring line 42*b* extends through the multilayer body 2A in the lamination direction of the multilayer body 2A from the upper surface of the outer periphery end 11*b* of the spiral wiring line 11 to the upper surface of the multilayer body 2A. In other words, the second vertical wiring line 42 extends through the second magnetic layer 22A in the lamination direction of the multilayer body 2A.

As illustrated in FIG. 3 and FIG. 23, similar to the second magnetic layer 22 of the first embodiment, the second magnetic layer 22A includes the base resin 72, the metal magnetic powder 73, and the non-magnetic powder 74. The base resin 72 has the voids 71, and the metal magnetic powder 73 and the non-magnetic powder 74 are contained in the base resin 72. In the second embodiment, the material of the second magnetic layer 22A is similar to the material of the second magnetic layer 22 of the above-described first embodiment.

In the second magnetic layer 22A, there is a particle of the metal magnetic powder 73 that is in contact with at least one of the voids 71 and with the non-magnetic powder 74. It is preferable that a plurality of particles of the metal magnetic powder 73 that are each in contact with at least one of the voids 71 and with the non-magnetic powder 74 be present in the second magnetic layer 22A. In addition, in the lamination direction of the multilayer body 2A, it is preferable that the inductor component 1A include a plurality of particles of the metal magnetic powder 73 that are each in contact with at least one of the voids 71 and with the non-magnetic powder 74. However, it is not necessary for the inductor component 1A to include a plurality of particles of the metal magnetic powder 73 that are each in contact with at least one of the voids 71 and with the non-magnetic powder 74 in the lamination direction of the multilayer body 2A. In addition, the second magnetic layer 22A does not need to include a plurality of particles of the metal magnetic powder 73 that are each in contact with at least one of the voids 71 and with the non-magnetic powder 74.

In the inductor component 1A, it is preferable that at least one of the voids 71 that is in contact with the metal magnetic powder 73 also be in contact with one of the vertical wiring lines 41 to 43. However, it is not necessary for the void 71 that is in contact with the metal magnetic powder 73 to be in contact with one of the vertical wiring lines 41 to 43.

It is preferable that, in the second magnetic layer 22A, the particle diameter of the non-magnetic powder 74 that is in contact with the metal magnetic powder 73 be one-third or less of the particle diameter of the metal magnetic powder 73, which is in contact with the non-magnetic powder 74. In the second magnetic layer 22A, the particle diameter of the non-magnetic powder 74 that is in contact with the metal magnetic powder 73 and the particle diameter of the metal magnetic powder 73, which is in contact with the non-magnetic powder 74, may be obtained by the method described above in the first embodiment. Note that, in the second magnetic layer 22A, the particle diameter of the non-magnetic powder 74 that is in contact with the metal magnetic powder 73 does not need to be one-third or less of the particle diameter of the metal magnetic powder 73, which is in contact with the non-magnetic powder 74.

In addition, in the second magnetic layer 22A, it is preferable that the cross-sectional shape of at least one of the voids 71 that is in contact with the metal magnetic powder 73 have different lengths in two orthogonal directions. Furthermore, regarding at least one of the voids 71 that is in contact with the metal magnetic powder 73 and that has a shape having different lengths in two orthogonal directions in its cross-sectional shape, it is further preferable that the major axis of the void 71 be longer than the equivalent circle diameter of the void 71 in the cross-sectional shape. The lengths of the major axis and so forth of the void 71 in the cross-sectional shape of the void 71 and the equivalent circle diameter of the void 71 may be obtained by the method described above in the first embodiment. Note that, in the second magnetic layer 22A, at least one of the voids 71 that is in contact with the metal magnetic powder 73 does not need to have different lengths in two orthogonal directions in its cross-sectional shape.

Advantageous Effects

Advantageous effects of the second embodiment that may be obtained in addition to advantageous effects similar to those in the first embodiment will now be described.

In the second magnetic layer 22A, there is a particle of the metal magnetic powder 73 that is in contact with at least one of the voids 71 and with the non-magnetic powder 74. At least one of the voids 71 that is in contact with the metal magnetic powder 73 and the non-magnetic powder 74 that is in contact with the metal magnetic powder 73 reduces stress that is generated in the second magnetic layer 22A and improves the insulating property of the second magnetic layer 22A. Since the second magnetic layer 22A can be used as an insulator, an insulator that is provided between the spiral wiring line 11 and the second magnetic layer 22A can be omitted.

(Manufacturing Method)

A method of manufacturing the inductor component 1A will now be described.

First, the steps of the method of manufacturing the inductor component 1 of the first embodiment that are illustrated in FIG. 7 to FIG. 11 are performed.

Figure 24:
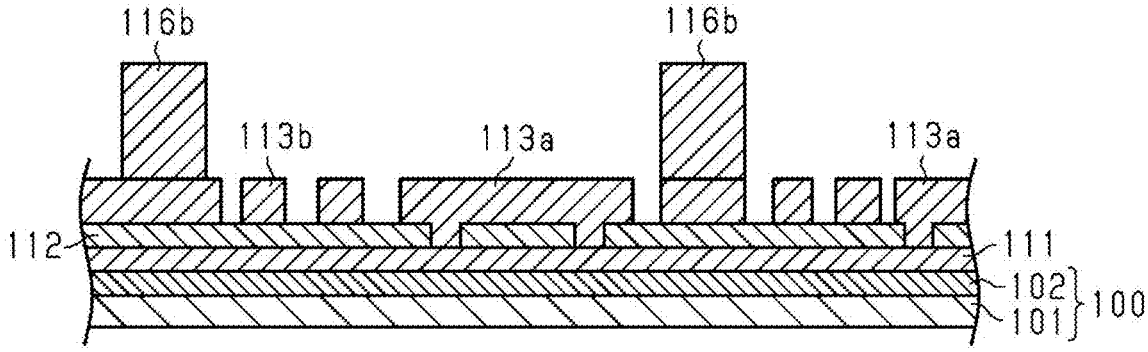
FIG. 24 is a diagram illustrating a process of manufacturing the inductor component according to the second embodiment.

After that, as illustrated in FIG. 24, the columnar wiring lines 116*b* are formed onto the spiral wiring line 113*b* by, for example, the SAP using a dry film resist.

Figure 25:
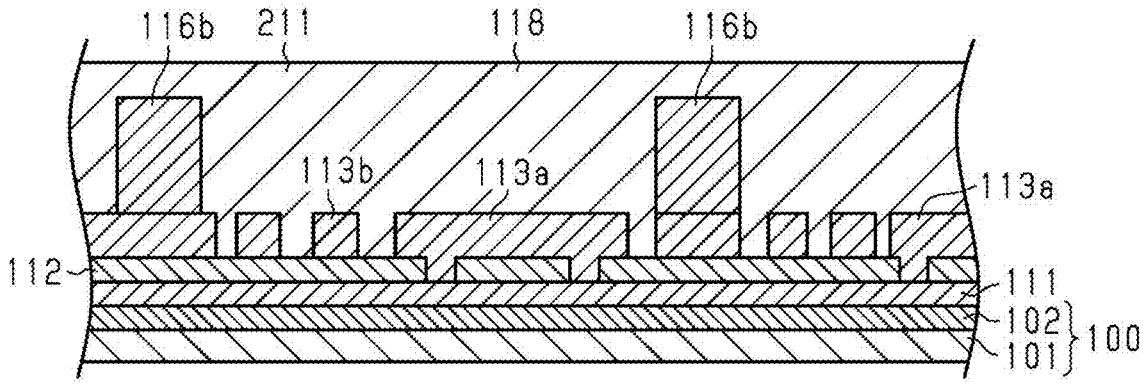
FIG. 25 is a diagram illustrating a process of manufacturing the inductor component according to the second embodiment.

Next, as illustrated in FIG. 25, the dummy copper portion 113*a*, the spiral wiring line 113*b*, and the columnar wiring lines 116*b* are covered with a magnetic layer 211. The magnetic layer 211 is made of the magnetic material 118 that includes the base resin 72 having the voids 71, the metal magnetic powder 73, and the non-magnetic powder 74. The magnetic material 118 (the magnetic layer 211) is thermo-compression-bonded and then thermally-cured by using a vacuum laminator, a press machine, or the like. In this case, the magnetic material 118 is injected into spaces between portions of the spiral wiring line 113*b* by press-fitting. In addition, similar to the above-described first embodiment, when the magnetic layer 211 is formed by using the magnetic material 118, the voids 71 are formed in the base resin 72.

Figure 26:
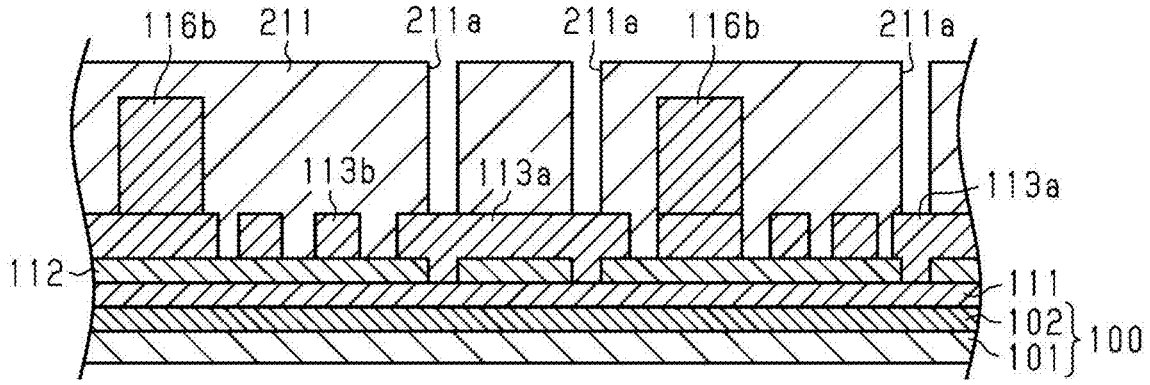
FIG. 26 is a diagram illustrating a process of manufacturing the inductor component according to the second embodiment.

Next, as illustrated in FIG. 26, cavities 211*a* are formed in the magnetic layer 211 by laser processing or the like.

Figure 27:
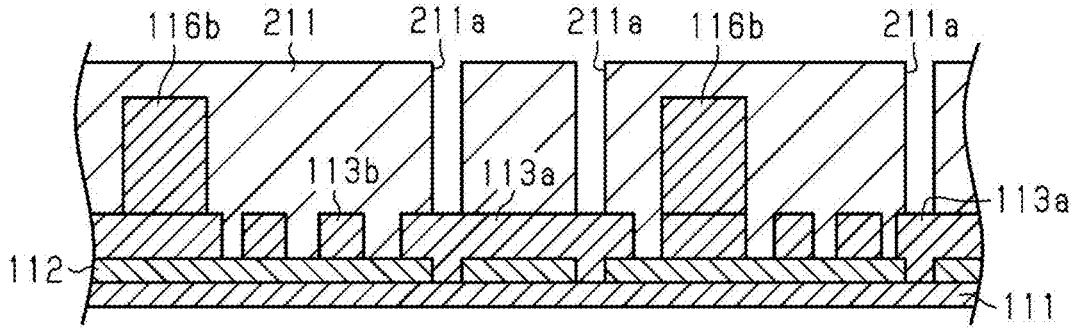
FIG. 27 is a diagram illustrating a process of manufacturing the inductor component according to the second embodiment.

After that, as illustrated in FIG. 27, the dummy core substrate 100 is separated from the dummy metal layer 111.

Figure 28:
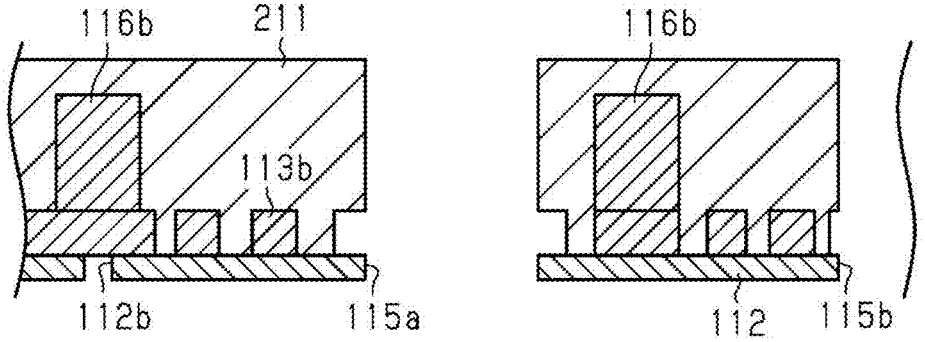
FIG. 28 is a diagram illustrating a process of manufacturing the inductor component according to the second embodiment.

Then, as illustrated in FIG. 28, the dummy metal layer 111 is removed by etching or the like. The dummy copper portion 113*a* is also removed by etching or the like. As a result, a hole 115*a* that corresponds to the internal-magnetic-path portion 23 and a hole 115*b* that corresponds to the external-magnetic-path portion 24 are formed.

After that, a cavity 112*b* is formed in the insulating layer 112 by laser processing or the like.

Figure 29:
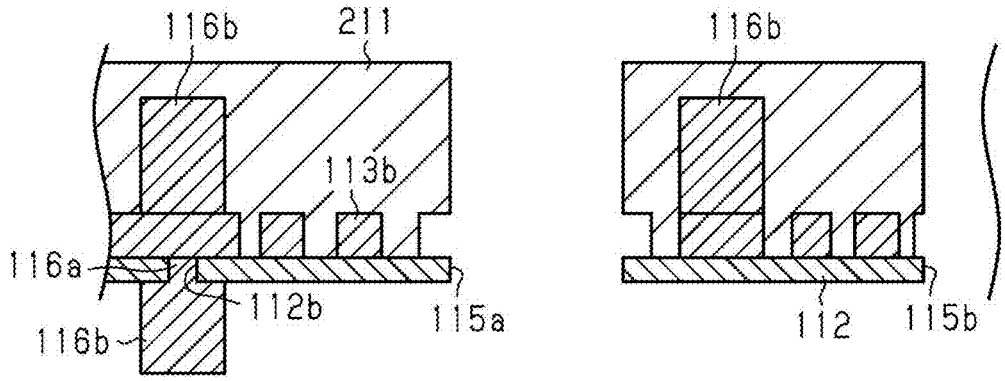
FIG. 29 is a diagram illustrating a process of manufacturing the inductor component according to the second embodiment.

Then, as illustrated in FIG. 29, by using the SAP, the via conductor 116*a* is formed by filling the cavity 112*b* with copper, and the columnar wiring line 116*b* is formed on the lower surface of the insulating layer 112.

Figure 30:
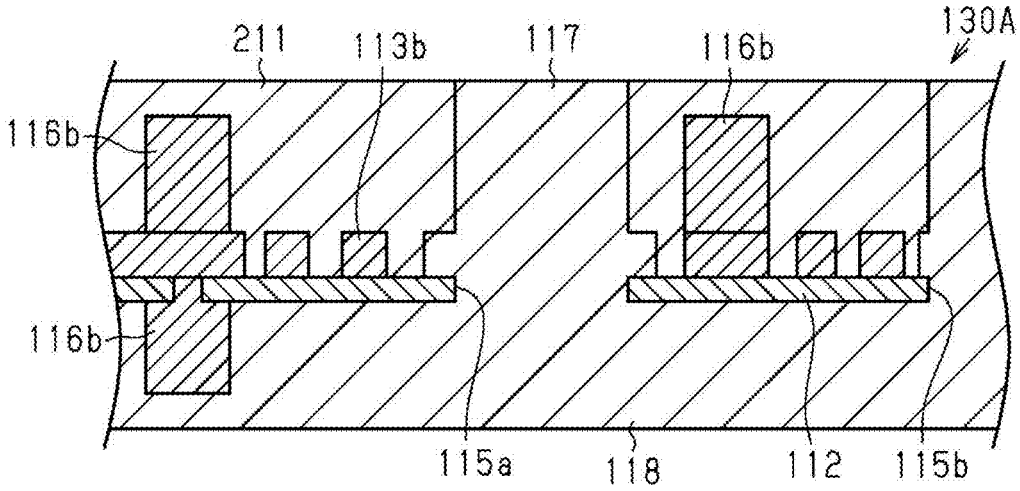
FIG. 30 is a diagram illustrating a process of manufacturing the inductor component according to the second embodiment.

Next, as illustrated in FIG. 30, the insulating layer 112 and the columnar wiring line 116*b*, which has been formed on the lower surface of the insulating layer 112, are covered with the magnetic layer 117, so that an inductor substrate 130A is formed. Similar to the magnetic layer 211, the magnetic layer 117 is made of the magnetic material 118 that includes the base resin 72 having the voids 71, the metal magnetic powder 73, and the non-magnetic powder 74. The magnetic material 118 (the magnetic layer 117) is thermo-compression-bonded and then thermally-cured by using a vacuum laminator, a press machine, or the like. In this case, the magnetic material 118 is also injected into the holes 115*a* and 115*b*. In addition, similar to the above-described first embodiment, when the magnetic layer 117 is formed by using the magnetic material 118, the voids 71 are formed in the base resin 72.

Figure 31:
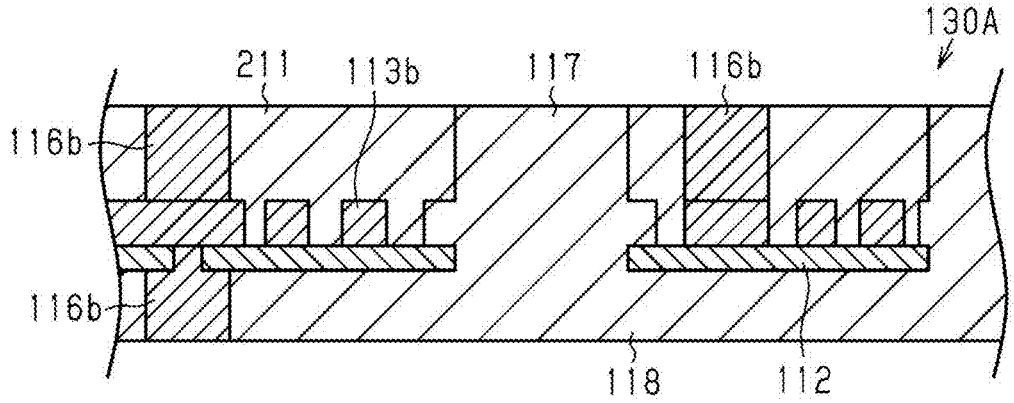
FIG. 31 is a diagram illustrating a process of manufacturing the inductor component according to the second embodiment.

Next, as illustrated in FIG. 31, the magnetic material 118 provided on the top of the inductor substrate 130A and the magnetic material 118 provided on the bottom of the inductor substrate 130A are each formed into a thin layer by a grinding method. In this case, portions of the columnar wiring lines 116*b* are exposed as a result of grinding the magnetic material 118, so that the exposed portions of the columnar wiring lines 116*b* are formed on the same plane as the magnetic material 118. Note that, by grinding the magnetic material 118 until the magnetic material 118 has a thickness that is sufficient to obtain an inductance, a reduction in the thickness of the inductor component 1A can be achieved.

Figure 32:
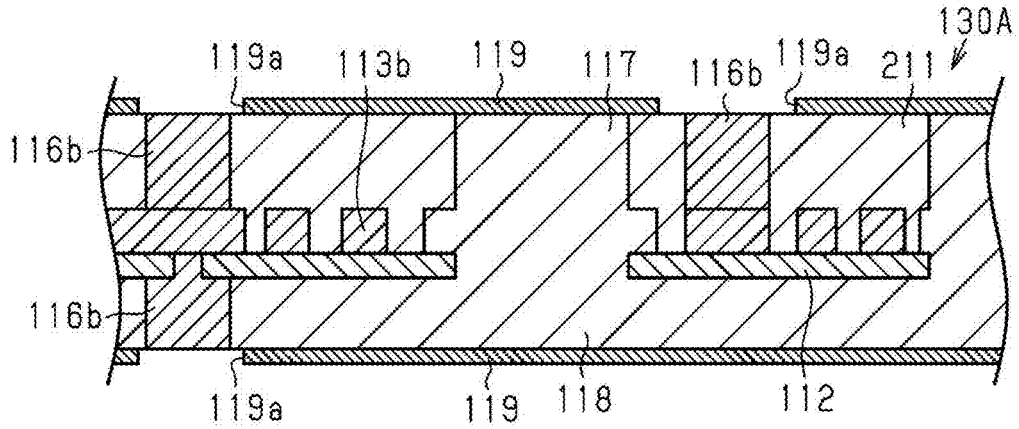
FIG. 32 is a diagram illustrating a process of manufacturing the inductor component according to the second embodiment.

Next, as illustrated in FIG. 32, the coating films 119 that are made of a non-magnetic insulating material are formed on the two surfaces of each of the magnetic layers 117 and 211 by a printing method. The formed coating films 119 have the cavities 119*a*. The external terminals 121 are to be formed in these cavities 119*a*. In the second embodiment, although a printing method is used to form the coating films 119 having the cavities 119*a*, the cavities 119*a* may be formed by a photolithography method.

Figure 33:
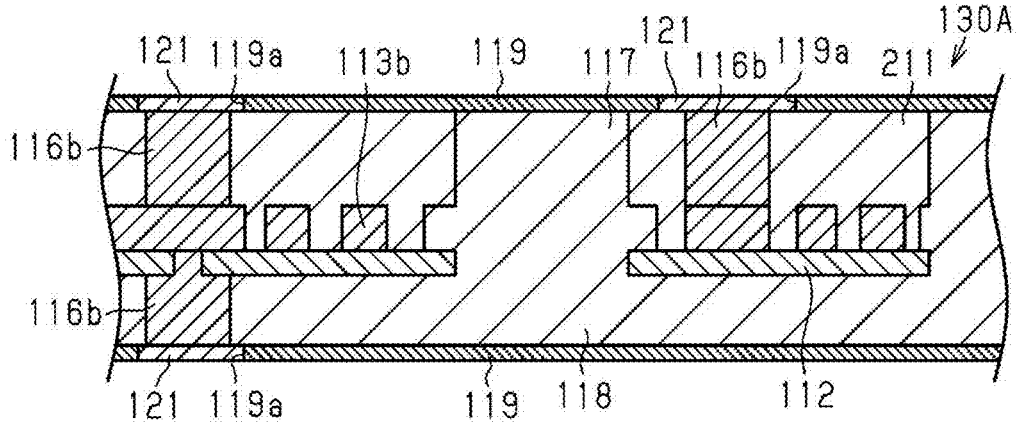
FIG. 33 is a diagram illustrating a process of manufacturing the inductor component according to the second embodiment.

Next, as illustrated in FIG. 33, the external terminals 121 are formed. The external terminals 121 are formed as metal films made of copper, nickel, gold, tin, or the like by, for example, electroless plating or electrolytic plating.

Figure 34:
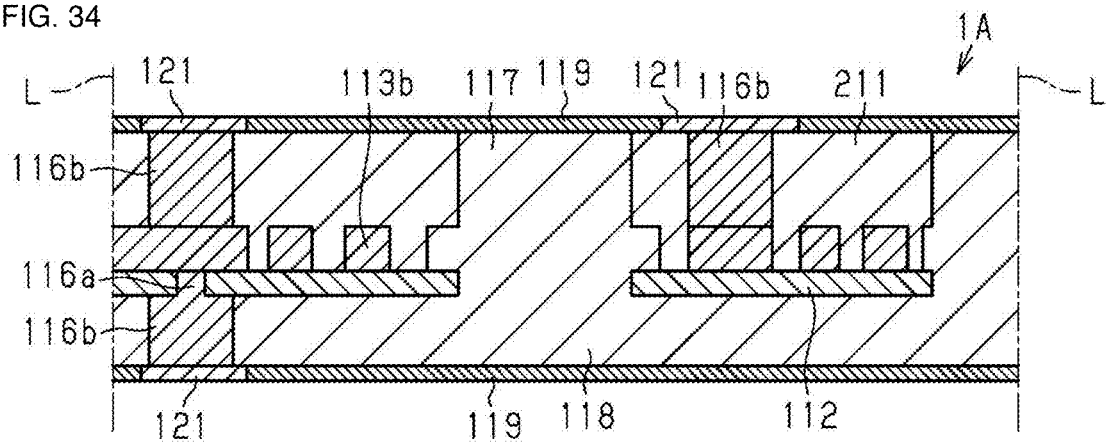
FIG. 34 is a diagram illustrating a process of manufacturing the inductor component according to the second embodiment.

After that, by cutting the inductor substrate 130A with a dicing machine along one-dot chain lines L as illustrated in FIG. 34, the inductor component 1A that is illustrated in FIG. 23 is obtained. Note that the spiral wiring line 113*b* illustrated in FIG. 34 corresponds to the spiral wiring line 11 illustrated in FIG. 23. The insulating layer 112 illustrated in FIG. 34 corresponds to the insulator 31A illustrated in FIG. 23. The magnetic layers 211 and 117 illustrated in FIG. 34 corresponds to the magnetic layer 20A illustrated in FIG. 23. The via conductor 116*a* illustrated in FIG. 34 corresponds to the via conductor 43*a* illustrated in FIG. 23, and the three columnar wiring lines 116*b* illustrated in FIG. 34 correspond to the columnar wiring lines 41*b* to 43*b* illustrated in FIG. 23. The three external terminals 121 illustrated in FIG. 34 correspond to the external terminals 51 to 53 illustrated in FIG. 23.

According to the second embodiment, the following advantageous effects are obtained in addition to advantageous effects similar to those in the first embodiment.

(2-1) The insulating property of the second magnetic layer 22A can be further improved by at least one of the voids 71 that is in contact with the metal magnetic powder 73 and the non-magnetic powder 74 that is in contact with the metal magnetic powder 73. Consequently, the second magnetic layer 22A can be used as an insulator, and thus, an insulator that is provided between the spiral wiring line 11 and the second magnetic layer 22A can be omitted. In the case where the chip size is not changed, the volume of the second magnetic layer 22A can be increased by an amount equal to the volume of the insulator, which is omitted, so that the inductance can be improved. Alternatively, the inductor component 1A can be reduced in size or thickness by an amount equal to the volume of the omitted insulator while maintaining the volume of the magnetic layer 20.

(2-2) The average particle diameter of the metal magnetic powder 73 is 1 μm or more and 5 μm or less (i.e., from 1 μm to 5 μm). The average particle diameter of the non-magnetic powder 74 is smaller than the average particle diameter of the metal magnetic powder 73. Accordingly, the non-magnetic powder 74 is likely to be positioned between the particles of the metal magnetic powder 73, and thus, even if the filling amount of the metal magnetic powder 73 increases, the particles of the metal magnetic powder 73 may be easily insulated from one another by the non-magnetic powder 74. Therefore, even if the filling amount of the metal magnetic powder 73 increases, the insulation between portions of the spiral wiring line 11 may easily be ensured by the second magnetic layer 22A.

(2-3) The particle diameter of the non-magnetic powder 74 that is in contact with the metal magnetic powder 73 is one-third or less of the particle diameter of the metal magnetic powder 73, which is in contact with the non-magnetic powder 74. Accordingly, the non-magnetic powder 74 is more likely to be positioned between the particles of the metal magnetic powder 73, and thus, even if the filling amount of the metal magnetic powder 73 increases, the particles of the metal magnetic powder 73 may further easily be insulated from one another by the non-magnetic powder 74. As a result, even if the filling amount of the metal magnetic powder 73 increases, the insulation between portions of the spiral wiring line 11 may further easily be ensured by the second magnetic layer 22A.

(2-4) In the lamination direction of the multilayer body 2A, the inductor component 1A includes a plurality of particles of the metal magnetic powder 73 that are each in contact with at least one of the voids 71 and with the non-magnetic powder 74. In addition, a plurality of particles of the metal magnetic powder 73 that are each in contact with at least one of the voids 71 and with the non-magnetic powder 74 are present both in the second magnetic layer 22A. Thus, the insulating property of the second magnetic layer 22A is further improved by the voids 71 and the non-magnetic powder 74 that are in contact with the plurality of particles of the metal magnetic powder 73. Therefore, the insulation between portions of the spiral wiring line 11 can be improved by the second magnetic layer 22A.

(2-5) The base resin 72 contains at least one of an epoxy-based resin and an acrylic resin. Consequently, the insulating property of the second magnetic layer 22A can be improved. Therefore, portions of the spiral wiring line 11 may further easily be insulated from one another by the second magnetic layer 22A.

(2-6) In the second magnetic layer 22A, the cross-sectional shape of at least one of the voids 71 that is in contact with the metal magnetic powder 73 has different lengths in two orthogonal directions. According to this configuration, the void 71 may have a non-spherical shape, and thus, the void 71 can be arranged along the surface of a particle of the metal magnetic powder 73. If the void 71 having a shape with different lengths in two orthogonal directions in its cross-sectional shape is arranged along the surface of a particle of the metal magnetic powder 73, the void 71 can be brought into contact with a wider area of the surface of the particle of the metal magnetic powder 73. As a result, the insulation between the particle and an adjacent particle of the metal magnetic powder 73 can be improved by the void 71. Therefore, the insulating property of the second magnetic layer 22A including the voids 71 can be further improved, so that portions of the spiral wiring line 11 may further easily be insulated from one another by the second magnetic layer 22A.

In addition, in the case where the major axis of at least one of the voids 71 that has a shape with different lengths in two orthogonal directions in its cross section is longer than the equivalent circle diameter of the void 71 in the cross section, the void 71 can be easily brought into contact with a wider area of the surface of a particle of the metal magnetic powder 73, the particle being in contact with the void 71. As a result, in the second magnetic layer 22A, the insulation between the particle and an adjacent particle of the metal magnetic powder 73 can be further improved by the void 71. Therefore, the insulating property of the second magnetic layer 22A including the voids 71 can be further improved, so that portions of the spiral wiring line 11 may further easily be insulated from one another by the second magnetic layer 22A.

(2-7) The thickness of the inductor component 1A is 0.5 mm or smaller. Since the second magnetic layer 22A can be used as an insulator, an insulator that is provided between the spiral wiring line 11 and the second magnetic layer 22A may be omitted, and this contributes to a reduction in the thickness of the inductor component 1A. Therefore, the inductor component whose thickness is further reduced to 0.5 mm or smaller may easily be obtained.

Third Embodiment

An inductor component according to a third embodiment will be described below.

Note that, in the third embodiment, the same components as in the above-described embodiments or components that correspond to those in the above-described embodiments are denoted by the same reference signs, and some or all of the descriptions thereof may sometimes be omitted.

Figure 35:
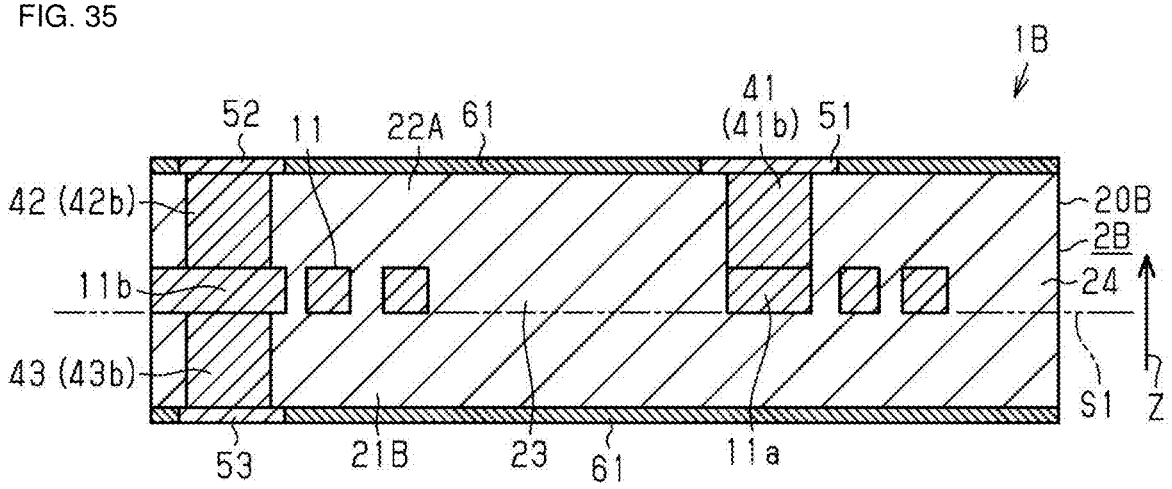
FIG. 35 is a sectional view of an inductor component according to a third embodiment.

An inductor component 1B of the third embodiment that is illustrated in FIG. 35 does not include an insulator unlike the inductor component 1 of the above-described first embodiment and the inductor component 1A of the above-described second embodiment. The inductor component 1B includes a multilayer body 2B instead of the multilayer body 2, which is included in the inductor component 1 of the first embodiment. The multilayer body 2B does not include an insulator and includes a magnetic layer 20B instead the magnetic layer 20 of the first embodiment. The magnetic layer 20B includes a first magnetic layer 21B, the second magnetic layer 22A, the internal-magnetic-path portion 23, and the external-magnetic-path portion 24. The first magnetic layer 21B is included in the magnetic layer 20B instead of the first magnetic layer 21 of the first embodiment.

The first magnetic layer 21B is in contact with the lower surface of the spiral wiring line 11 from the lower side of the spiral wiring line 11 (in the positive Z-axis direction) and covers the lower surface of the spiral wiring line 11. In other words, in the inductor component 1B of the third embodiment, the first magnetic layer 21B and the second magnetic layer 22A are directly in contact with the spiral wiring line 11 so as to cover the surfaces of the spiral wiring line 11.

The first vertical wiring line 41 of the third embodiment is formed of only the first columnar wiring line 41*b* like the first vertical wiring line 41 of the second embodiment. The first columnar wiring line 41*b* extends through the multilayer body 2B in the lamination direction of the multilayer body 2B (which is parallel to the Z-axis direction) from the upper surface of the inner periphery end 11*a* of the spiral wiring line 11 to the upper surface of the multilayer body 2B. The second vertical wiring line 42 of the third embodiment is formed of only the second columnar wiring line 42*b* like the second vertical wiring line 42 of the second embodiment. The second columnar wiring line 42*b* extends through the multilayer body 2B in the lamination direction of the multilayer body 2B from the upper surface of the outer periphery end 11*b* of the spiral wiring line 11 to the upper surface of the multilayer body 2B. The third vertical wiring line 43 of the third embodiment does not include the third via conductor 43*a* and is formed of only the third columnar wiring line 43*b*. The third columnar wiring line 43*b* extends through the multilayer body 2B in the lamination direction of the multilayer body 2B from the lower surface of the outer periphery end 11*b* of the spiral wiring line 11 to the lower surface of the multilayer body 2B. In other words, the third vertical wiring line 43 extends through the first magnetic layer 21B in the lamination direction of the multilayer body 2B.

As illustrated in FIG. 3 and FIG. 35, similar to the first magnetic layer 21 of the first embodiment, the first magnetic layer 21B includes the base resin 72, the metal magnetic powder 73, and the non-magnetic powder 74. The base resin 72 has the voids 71, and the metal magnetic powder 73 and the non-magnetic powder 74 are contained in the base resin 72. In the third embodiment, the material of the first magnetic layer 21B is similar to the material of the first magnetic layer 21 of the above-described first embodiment.

In the first magnetic layer 21B, there is a particle of the metal magnetic powder 73 that is in contact with at least one of the voids 71 and with the non-magnetic powder 74. It is preferable that a plurality of particles of the metal magnetic powder 73 that are each in contact with at least one of the voids 71 and with the non-magnetic powder 74 be present in the first magnetic layer 21B. In addition, in the lamination direction of the multilayer body 2B, it is preferable that the inductor component 1B include a plurality of particles of the metal magnetic powder 73 that are each in contact with at least one of the voids 71 and with the non-magnetic powder 74. However, it is not necessary for the inductor component 1B to include a plurality of particles of the metal magnetic powder 73 that are each in contact with at least one of the voids 71 and with the non-magnetic powder 74 in the lamination direction of the multilayer body 2B. In addition, the first magnetic layer 21B does not need to include a plurality of particles of the metal magnetic powder 73 that are each in contact with at least one of the voids 71 and with the non-magnetic powder 74.

In the inductor component 1B, it is preferable that at least one of the voids 71 that is in contact with the metal magnetic powder 73 also be in contact with one of the vertical wiring lines 41 to 43. However, it is not necessary for the void 71 that is in contact with the metal magnetic powder 73 to be in contact with one of the vertical wiring lines 41 to 43.

It is preferable that, in the first magnetic layer 21B, the particle diameter of the non-magnetic powder 74 that is in contact with the metal magnetic powder 73 be one-third or less of the particle diameter of the metal magnetic powder 73, which is in contact with the non-magnetic powder 74. In the first magnetic layer 21B, the particle diameter of the non-magnetic powder 74 that is in contact with the metal magnetic powder 73 and the particle diameter of the metal magnetic powder 73, which is in contact with the non-magnetic powder 74, may be obtained by the method described above in the first embodiment. Note that, in the first magnetic layer 21B, the particle diameter of the non-magnetic powder 74 that is in contact with the metal magnetic powder 73 does not need to be one-third or less of the particle diameter of the metal magnetic powder 73, which is in contact with the non-magnetic powder 74.

In addition, in the first magnetic layer 21B, it is preferable that the cross-sectional shape of at least one of the voids 71 that is in contact with the metal magnetic powder 73 have different lengths in two orthogonal directions. Furthermore, regarding at least one of the voids 71 that is in contact with the metal magnetic powder 73 and that has a shape having different lengths in two orthogonal directions in its cross-sectional shape, it is further preferable that the major axis of the void 71 be longer than the equivalent circle diameter of the void 71 in the cross-sectional shape. The lengths of the major axis and so forth of the void 71 in the cross-sectional shape of the void 71 and the equivalent circle diameter of the void 71 may be obtained by the method described above in the first embodiment. Note that, in the first magnetic layer 21B, at least one of the voids 71 that is in contact with the metal magnetic powder 73 does not need to have different lengths in two orthogonal directions in its cross-sectional shape.

Note that, in the third embodiment, the second magnetic layer 22A is disposed between portions of the spiral wiring line 11. In addition, the second magnetic layer 22A is in contact with the upper (in the negative Z-axis direction) and lateral sides of the spiral wiring line 11 and covers the surface of the spiral wiring line 11. However, the first magnetic layer 21B may be disposed between portions of the spiral wiring line 11. In this case, the first magnetic layer 21B is in contact with the lower (in the positive Z-axis direction) and lateral sides of the spiral wiring line 11 and covers the surface of the spiral wiring line 11.

Advantageous Effects

Advantageous effects of the third embodiment that may be obtained in addition to advantageous effects similar to those in the above-described first and second embodiments will now be described.

In the first magnetic layer 21B, there is a particle of the metal magnetic powder 73 that is in contact with at least one of the voids 71 and with the non-magnetic powder 74. At least one of the voids 71 that is in contact with the metal magnetic powder 73 and the non-magnetic powder 74 that is in contact with the metal magnetic powder 73 reduces stress that is generated in the first magnetic layer 21B and improves the insulating property of the first magnetic layer 21B. Since the first magnetic layer 21B can be used as an insulator, an insulator that is provided between the spiral wiring line 11 and the first magnetic layer 21B can be omitted. Note that an insulator is one of the factors that hinder a reduction in the size of the inductor component, and thus, it is desirable that such an insulator not be included in the inductor component. As in the third embodiment, by employing a configuration in which portions of the spiral wiring line 11 are insulated from one another by the first magnetic layer 21B and the second magnetic layer 22A, the inductor component 1B capable of ensuring the insulation between portions of the spiral wiring line 11 without including an insulator can be provided.

(Manufacturing Method)

A method of manufacturing the inductor component 1B will now be described.

First, the steps of the method of manufacturing the inductor component 1 of the first embodiment that are illustrated in FIG. 7 to FIG. 11 are performed. Next, the steps of the method of manufacturing the inductor component 1A of the second embodiment that are illustrated in FIG. 24 to FIG. 27 are performed.

Figure 36:
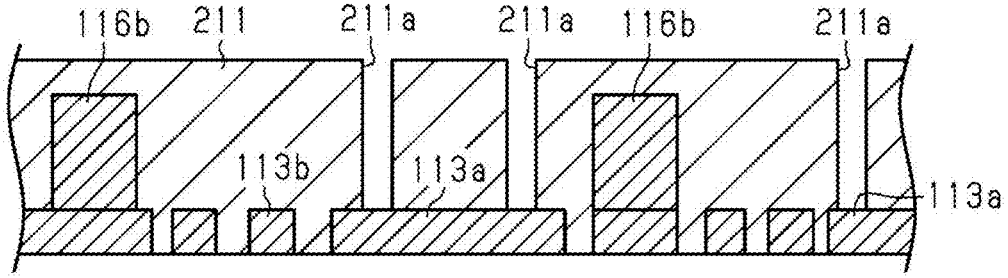
FIG. 36 is a diagram illustrating a process of manufacturing the inductor component according to the third embodiment.

After that, as illustrated in FIG. 36, the dummy metal layer 111 and the insulating layers 112 are removed by grinding.

Figure 37:
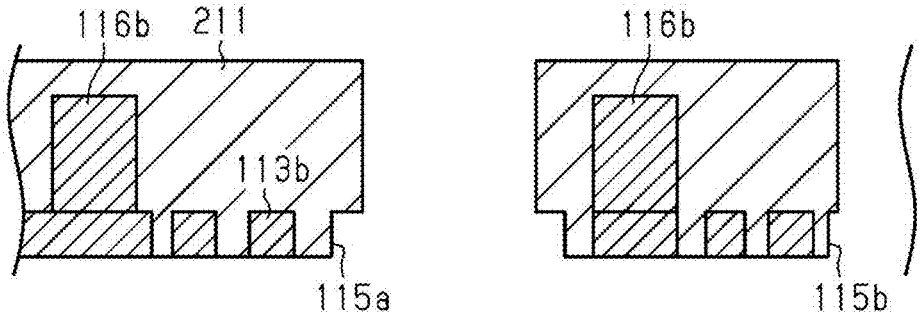
FIG. 37 is a diagram illustrating a process of manufacturing the inductor component according to the third embodiment.

Next, as illustrated in FIG. 37, the dummy copper portion 113*a* is removed by etching or the like. As a result, the hole 115*a* corresponding to the internal-magnetic-path portion 23 and the hole 115*b* corresponding to the external-magnetic-path portion 24 are formed.

Figure 38:
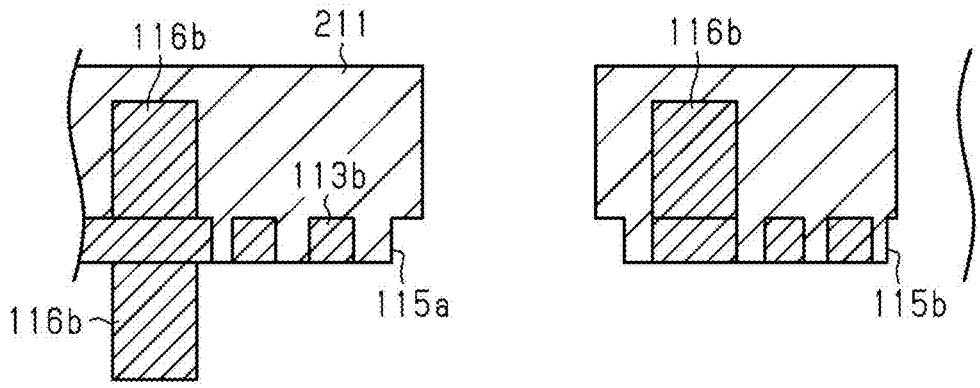
FIG. 38 is a diagram illustrating a process of manufacturing the inductor component according to the third embodiment.

After that, as illustrated in FIG. 38, the columnar wiring line 116*b* is formed onto the lower surface of the spiral wiring line 113*b* by, for example, the SAP using a dry film resist.

Figure 39:
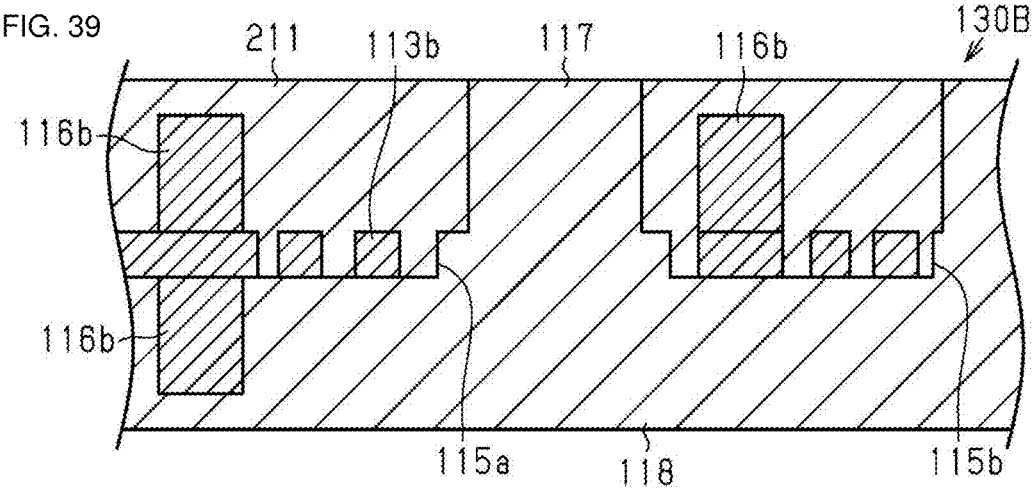
FIG. 39 is a diagram illustrating a process of manufacturing the inductor component according to the third embodiment.

Subsequently, as illustrated in FIG. 39, the spiral wiring line 113*b*, the magnetic layer 211, and the columnar wiring line 116*b*, which is formed on the lower surface of the spiral wiring line 113*b*, are covered with the magnetic layer 117, so that an inductor substrate 130B is formed. The magnetic layer 117 is made of the magnetic material 118 like the magnetic layer 211. The magnetic material 118 (the magnetic layer 117) is thermocompression-bonded and then thermally-cured by using a vacuum laminator, a press machine, or the like. In this case, the magnetic material 118 is also injected into the holes 115*a* and 115*b*. In addition, similar to the above-described embodiments, when the magnetic layer 117 is formed by using the magnetic material 118, the voids 71 are formed in the base resin 72.

Figure 40:
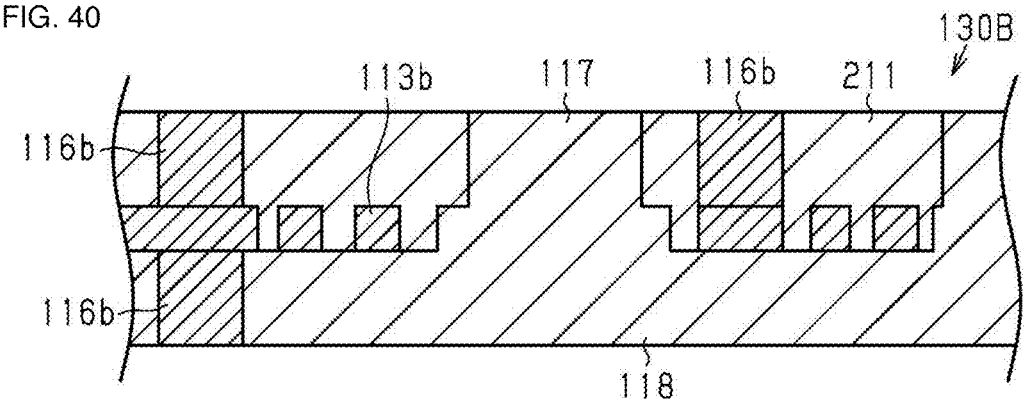
FIG. 40 is a diagram illustrating a process of manufacturing the inductor component according to the third embodiment.

Next, as illustrated in FIG. 40, the magnetic material 118 provided on the top of the inductor substrate 130B and the magnetic material 118 provided on the bottom of the inductor substrate 130B are each formed into a thin layer by a grinding method. In this case, portions of the columnar wiring lines 116*b* are exposed as a result of grinding the magnetic material 118, so that the exposed portions of the columnar wiring lines 116*b* are formed on the same plane as the magnetic material 118. Note that, by grinding the magnetic material 118 until the magnetic material 118 has a thickness that is sufficient to obtain an inductance, a reduction in the thickness of the inductor component 1B can be achieved.

Figure 41:
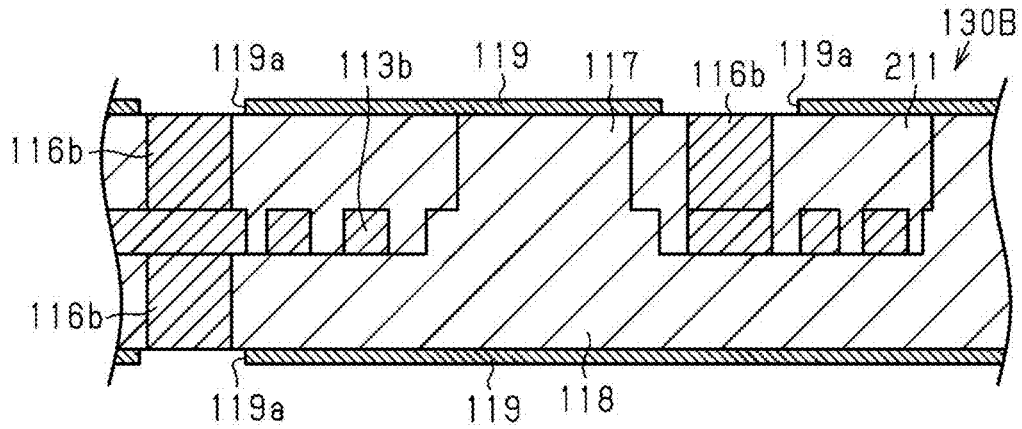
FIG. 41 is a diagram illustrating a process of manufacturing the inductor component according to the third embodiment.

Next, as illustrated in FIG. 41, the coating films 119 that are made of a non-magnetic insulating material are formed on the two surfaces of each of the magnetic layers 117 and 211 by a printing method. The formed coating films 119 have the cavities 119*a*. The external terminals 121 are to be formed in these cavities 119*a*. In the third embodiment, although a printing method is used to form the coating films 119 having the cavities 119*a*, the cavities 119*a* may be formed by a photolithography method.

Figure 42:
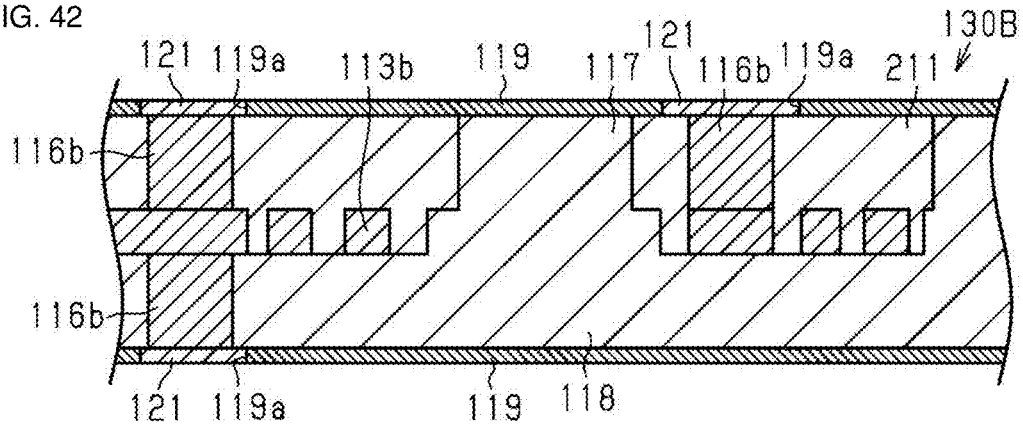
FIG. 42 is a diagram illustrating a process of manufacturing the inductor component according to the third embodiment.
Figure 43:
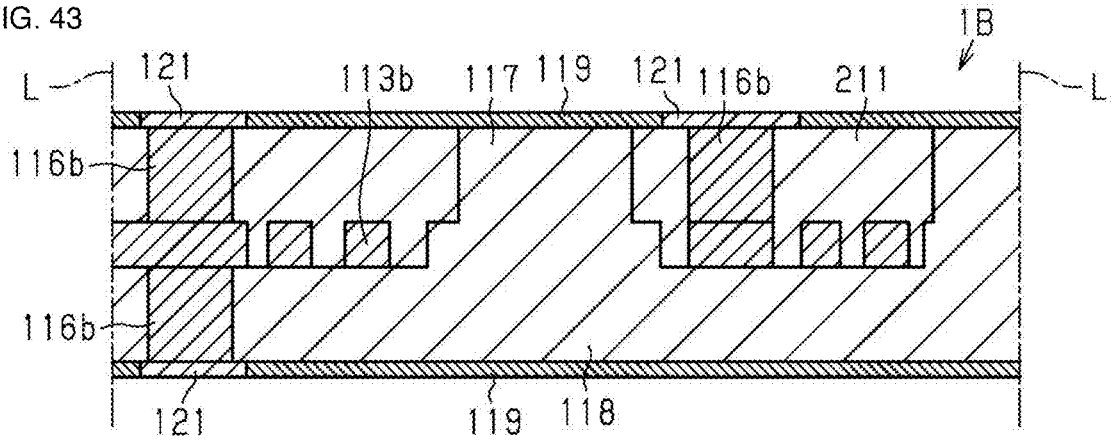
FIG. 43 is a diagram illustrating a process of manufacturing the inductor component according to the third embodiment.

Next, as illustrated in FIG. 42, the external terminals 121 are formed. The external terminals 121 are formed as metal films made of copper, nickel, gold, tin, or the like by, for example, electroless plating or electrolytic plating. After that, by cutting the inductor substrate 130B with a dicing machine along one-dot chain lines L as illustrated in FIG. 43, the inductor component 1B that is illustrated in FIG. 35 is obtained. Note that the spiral wiring line 113*b* illustrated in FIG. 43 corresponds to the spiral wiring line 11 illustrated in FIG. 35. The magnetic layers 117 and 211 illustrated in FIG. 43 corresponds to the magnetic layer 20B illustrated in FIG. 35. The three columnar wiring lines 116*b* illustrated in FIG. 43 correspond to the columnar wiring lines 41*b* to 43*b* illustrated in FIG. 35, that is, the vertical wiring lines 41 and 43. The three external terminals 121 illustrated in FIG. 43 correspond to the external terminals 51 to 53 illustrated in FIG. 35.

According to the third embodiment, the following advantageous effects are obtained in addition to advantageous effects similar to (1-1) to (1-11), (1-13), (1-14), and (1-16) in the above-described first embodiment.

(3-1) At least one of the voids 71 that is in contact with the metal magnetic powder 73 and the non-magnetic powder 74 that is in contact with the metal magnetic powder 73 improves the insulating property of the first magnetic layer 21B and the insulating property of the second magnetic layer 22A. Thus, the first magnetic layer 21B and the second magnetic layer 22A can each be used as an insulator, an insulator that is provided between the spiral wiring line 11 and the second magnetic layer 22A and an insulator that is provided between the spiral wiring line 11 and the first magnetic layer 21B can be omitted. In the case where the chip size is not changed, the volumes of the first magnetic layer 21B and the second magnetic layer 22A can be further increased by an amount equal to the total volume of the insulators, which are omitted, so that the inductance can be improved. Alternatively, the inductor component 1B can be reduced in size or thickness by an amount equal to the total volume of the omitted insulators while maintaining the volumes of the first magnetic layer 21B and the second magnetic layer 22A.

(3-2) The average particle diameter of the metal magnetic powder 73 is 1 μm or more and 5 μm or less (i.e., from 1 μm to 5 μm). The average particle diameter of the non-magnetic powder 74 is smaller than the average particle diameter of the metal magnetic powder 73. Accordingly, the non-magnetic powder 74 is likely to be positioned between the particles of the metal magnetic powder 73, and thus, even if the filling amount of the metal magnetic powder 73 increases, the particles of the metal magnetic powder 73 may be easily insulated from one another by the non-magnetic powder 74. Therefore, even if the filling amount of the metal magnetic powder 73 increases, the insulation between portions of the spiral wiring line 11 may easily be ensured by the first magnetic layer 21B and the second magnetic layer 22A.

(3-3) The particle diameter of the non-magnetic powder 74 that is in contact with the metal magnetic powder 73 is one-third or less of the particle diameter of the metal magnetic powder 73, which is in contact with the non-magnetic powder 74. Accordingly, the non-magnetic powder 74 is more likely to be positioned between the particles of the metal magnetic powder 73, and thus, even if the filling amount of the metal magnetic powder 73 increases, the particles of the metal magnetic powder 73 may further easily be insulated from one another by the non-magnetic powder 74. As a result, even if the filling amount of the metal magnetic powder 73 increases, the insulation between portions of the spiral wiring line 11 may further easily be ensured by the first magnetic layer 21B and the second magnetic layer 22A.

(3-4) In the lamination direction of the multilayer body 2B, the inductor component 1B includes a plurality of particles of the metal magnetic powder 73 that are each in contact with at least one of the voids 71 and with the non-magnetic powder 74. In addition, a plurality of particles of the metal magnetic powder 73 that are each in contact with at least one of the voids 71 and with the non-magnetic powder 74 are present both in the first magnetic layer 21B and the second magnetic layer 22A. Thus, the insulating property of the first magnetic layer 21B and the insulating property of the second magnetic layer 22A are further improved by the voids 71 and the non-magnetic powder 74 that are in contact with the plurality of particles of the metal magnetic powder 73. Therefore, the insulation between portions of the spiral wiring line 11 can be improved by the first magnetic layer 21B and the second magnetic layer 22A.

(3-5) The base resin 72 contains at least one of an epoxy-based resin and an acrylic resin. Consequently, the insulating property of the first magnetic layer 21B and the insulating property of the second magnetic layer 22A can be improved. Therefore, portions of the spiral wiring line 11 may further easily be insulated from one another by the first magnetic layer 21B and the second magnetic layer 22A.

(3-6) In each of the first magnetic layer 21B and the second magnetic layer 22A, the cross-sectional shape of at least one of the voids 71 that is in contact with the metal magnetic powder 73 has different lengths in two orthogonal directions. According to this configuration, the void 71 may have a non-spherical shape, and thus, the void 71 can be arranged along the surface of a particle of the metal magnetic powder 73. If the void 71 having a shape with different lengths in two orthogonal directions in its cross-sectional shape is arranged along the surface of a particle of the metal magnetic powder 73, the void 71 can be brought into contact with a wider area of the surface of the particle of the metal magnetic powder 73. As a result, the insulation between the particle and an adjacent particle of the metal magnetic powder 73 can be improved by the void 71. Therefore, the insulating property of the first magnetic layer 21B including the voids 71 and the insulating property of the second magnetic layer 22A including the voids 71 can be further improved, so that portions of the spiral wiring line 11 may further easily be insulated from one another by the first magnetic layer 21B and the second magnetic layer 22A.

In addition, in the case where the major axis of each of the voids 71 having a shape with different lengths in two orthogonal directions in its cross section is longer than the equivalent circle diameter of the void 71 in the cross section, the void 71 can be easily brought into contact with a wider area of the surface of a particle of the metal magnetic powder 73, the particle being in contact with the void 71. As a result, in the first magnetic layer 21B and the second magnetic layer 22A, each of which has the voids 71, the insulation between particles of the metal magnetic powder 73 that are adjacent to each other with one of the voids 71 interposed therebetween can be further improved by the void 71. Therefore, the insulating property of the first magnetic layer 21B including the voids 71 and the insulating property of the second magnetic layer 22A including the voids 71 can be further improved, so that portions of the spiral wiring line 11 may further easily be insulated from one another by the first magnetic layer 21B and the second magnetic layer 22A.

(3-7) The thickness of the inductor component 1B is 0.5 mm or smaller. Since the first magnetic layer 21B and the second magnetic layer 22A can each be used as an insulator, the insulator 31A provided between the spiral wiring line 11 and the first magnetic layer 21B and an insulator that is provided between the spiral wiring line 11 and the second magnetic layer 22A can be omitted, and this contributes to a further reduction in the thickness of the inductor component 1B. Therefore, the inductor component whose thickness is further reduced to 0.5 mm or smaller may further easily be obtained.

<Modifications>

The above-described embodiments can also be implemented by making modifications in the following manner. The above-described embodiments and the following modifications can be combined and implemented as long as it is technically consistent.

In the above-described embodiments, each of the inductor components 1, 1A, and 1B is configured to include only one spiral wiring line 11. However, each of the inductor components 1, 1A, and 1B may include a plurality of spiral wiring lines 11.

More specifically, the inductor component may include a plurality of spiral wiring lines on the same plane. In this case, the inductor component may be an inductor array in which a plurality of spiral wiring lines are not electrically connected to each other in the inductor component and are connected to different external terminals. Alternatively, the inductor component may have a configuration in which a plurality of spiral wiring lines are electrically connected to each other in the inductor component.

For example, in the inductor component 1 of the first embodiment, a plurality of spiral wiring lines 11 may be provided on the same plane. In this case, in the inductor component 1 that includes the plurality of spiral wiring lines 11 arranged on the same plane, advantageous effects similar to those of the first embodiment can be obtained.

In addition, in the inductor component 1 that includes the plurality of spiral wiring lines 11 arranged on the same plane, the insulating property of the magnetic layer 20 is improved by the voids 71 and the non-magnetic powder 74 that are in contact with the metal magnetic powder 73. Thus, the insulation between portions of each of the spiral wiring lines 11 and the insulation between the spiral wiring lines 11 can be ensured by the magnetic layer 20. Therefore, a portion of or the entire insulator 31 can be omitted in the inductor component 1. If a portion of or the entire insulator 31 is omitted in the inductor component 1, in the case where the chip size is not changed, the volumes of both the first magnetic layer 21 and the second magnetic layer 22 or the volume of one of the first magnetic layer 21 and the second magnetic layer 22 can be further increased by an amount equal to the volume of the insulator 31, which is omitted, so that the inductance can be improved. Alternatively, the inductor component 1 can be reduced in size or thickness by an amount equal to the volume of the omitted insulator while maintaining the volumes of the first magnetic layer 21 and the second magnetic layer 22.

Note that, in the inductor component 1A of the above-described second embodiment and the inductor component 1B of the above-described third embodiment, a plurality of spiral wiring lines 11 may be provided on the same plane.

In addition, the spiral wiring line included in the inductor component may have a plurality of spiral wiring layers that are laminated together. Note that each of the spiral wiring layers is an example of an inductor wiring layer.

Figure 44:
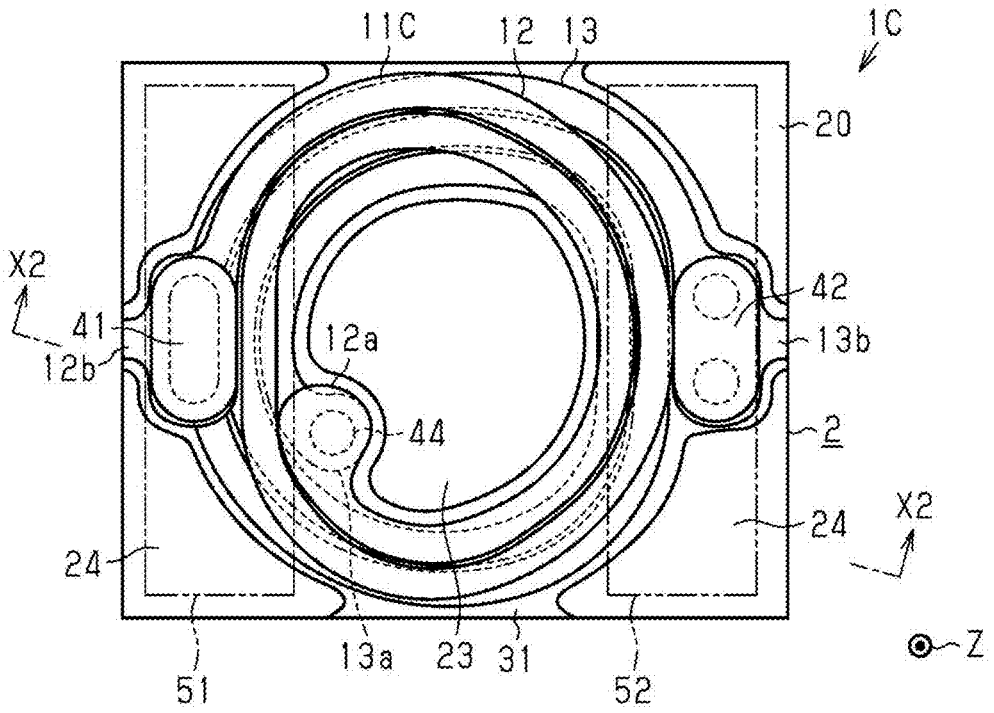
FIG. 44 is a plan view illustrating an inductor component according to a modification in a see-through manner.
Figure 45:
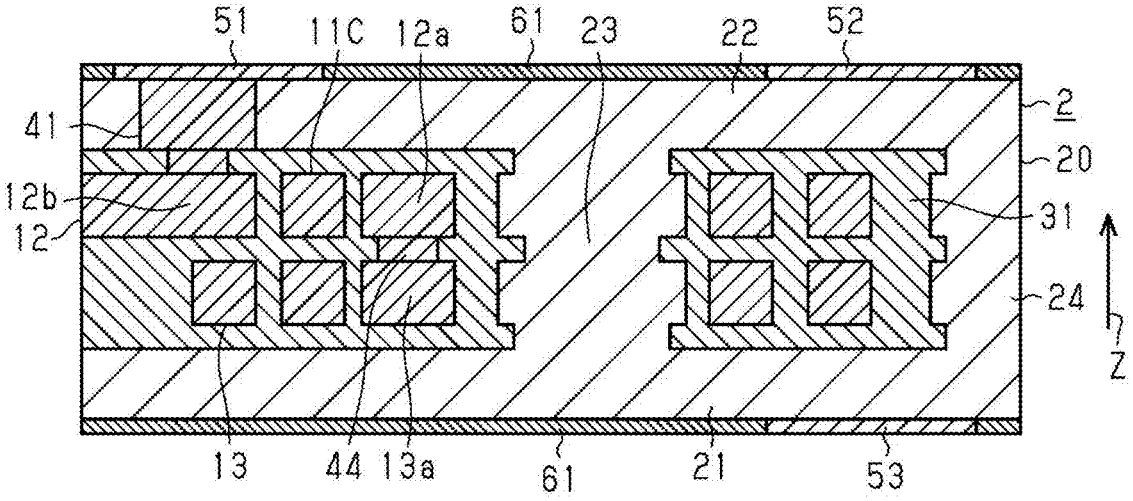
FIG. 45 is a sectional view of the inductor component according to the modification (a sectional view taken along line X2-X2 of FIG. 44).

For example, an inductor component 1C that is illustrated in FIG. 44 and FIG. 45 includes a spiral wiring line 11C disposed in the multilayer body 2. Note that, in FIG. 44 and FIG. 45, the same components as in the above-described first embodiments or components that correspond to those in the above-described embodiments are denoted by the same reference signs. In this modification, the spiral wiring line 11C is disposed in the magnetic layer 20 included in the multilayer body 2. In addition, the insulator 31 is disposed between the spiral wiring line 11C and the magnetic layer 20. The spiral wiring line 11C includes two spiral wiring layers 12 and 13 that are laminated together.

The first spiral wiring layer 12 and the second spiral wiring layer 13 are laminated together in the lamination direction of the multilayer body 2 (which is parallel to the Z-axis direction in FIG. 45) such that the first spiral wiring layer 12 is located above and overlaps the second spiral wiring layer 13. The first spiral wiring layer 12 is formed of a wiring line that is wound so as to extend in a spiral manner in the clockwise direction from an outer periphery end 12*b* toward an inner periphery end 12*a* when viewed from above. The second spiral wiring layer 13 is formed of a wiring line that is wound so as to extend in a spiral manner in the clockwise direction from an inner periphery end 13*a* toward an outer periphery end 13*b* when viewed from above. The first spiral wiring layer 12 and the second spiral wiring layer 13 are each wound in a planar form.

The outer periphery end 12*b* of the first spiral wiring layer 12 is connected to the first external terminal 51 by the first vertical wiring line 41 that is positioned above the outer periphery end 12*b*. The inner periphery end 12*a* of the first spiral wiring layer 12 is connected to the inner periphery end 13*a* of the second spiral wiring layer 13 by a connection via conductor 44 that is positioned below the inner periphery end 12*a*. In other words, the first spiral wiring layer 12 and the second spiral wiring layer 13 are connected in series to each other by the connection via conductor 44.

The outer periphery end 13*b* of the second spiral wiring layer 13 is connected to the external terminal 52 by the second vertical wiring line 42 that is positioned above the outer periphery end 13*b*. The outer periphery end 13*b* of the second spiral wiring layer 13 is connected to the third external terminal 53 by the third vertical wiring line 43 (not illustrated) that is positioned below the outer periphery end 12*b*.

In the inductor component 1C, since the first spiral wiring layer 12 and the second spiral wiring layer 13 are connected in series to each other by the connection via conductor 44, the number of turns of the spiral wiring line 11C is increased. Therefore, the inductance can be improved. In addition, since the first spiral wiring layer 12 and the second spiral wiring layer 13 are laminated together in the Z-axis direction, the number of turns of the spiral wiring line 11C can be increased without increasing the area of the inductor component 1C when viewed in the Z-axis direction.

In the inductor component 1C that includes the spiral wiring line 11C including the first spiral wiring layer 12 and the second spiral wiring layer 13, which are laminated together, advantageous effects similar to those of the first embodiment can be obtained.

In addition, in the inductor component 1C, the insulating property of the magnetic layer 20 is improved by the voids 71 and the non-magnetic powder 74 that are in contact with the metal magnetic powder 73. Thus, the insulation between the first spiral wiring layer 12 and the second spiral wiring layer 13, the insulation between portions of the first spiral wiring layer 12, and the insulation between portions of the second spiral wiring layer 13 can be ensured by the magnetic layer 20. Therefore, a portion of or the entire insulator 31 can be omitted in the inductor component 1C. If a portion of or the entire insulator 31 is omitted in the inductor component 1C, in the case where the chip size is not changed, the volume of the magnetic layer 20 can be further increased by an amount equal to the volume of the insulator 31, which is omitted, so that the inductance can be improved. Alternatively, the inductor component 1C can be reduced in size or thickness by an amount equal to the volume of the omitted insulator while maintaining the volume of the magnetic layer 20.

Note that an inductor component that includes a spiral wiring line including a plurality of spiral wiring layers, which are laminated together, may have a configuration in which a plurality of spiral wiring layers are provided on the same plane. In addition, the inductor wiring layers are not limited to spiral wiring layers and may be commonly known wiring layers having various shapes including a wiring layer having a meandering shape.

In the above-described first embodiment, the magnetic layer 20 may further include ferrite powder. In this case, as a result of the magnetic layer 20 further including ferrite powder, the inductance can be improved. In addition, since the insulating property of ferrite powder is higher than that of the metal magnetic powder 73, which contains iron, the insulating property of the magnetic layer 20 can be improved. Similarly, the magnetic layer 20A included in the inductor component 1A of the above-described second embodiment and the magnetic layer 20B included in the inductor component 1B of the above-described third embodiment may further include ferrite powder.

The inductor component 1 of the above-described first embodiment does not need to include the external terminals 51 to 53. For example, the inductor component 1 that does not include the external terminals 51 to 53 is used an embedded-type component that is configured to be installed by being embedded in a hole formed in a multilayer substrate. In this case, the inductor component 1 is electrically connected to wiring patterns of the multilayer substrate after being embedded in the multilayer substrate. More specifically, in the multilayer substrate, through holes are formed in an insulating layer covering the inductor component 1 by laser processing, etching, or the like such that the through holes are formed at positions overlapping the exposed surface 41*c* to 43*c* of the inductor component 1. Then, the through holes are filled with an electrically conductive material, and as a result, the vertical wiring lines 41 to 43 and the wiring patterns of the multilayer substrate are via-connected to one another.

In each of the above-described embodiments, the inductor component has been described by taking the spiral wiring line 11 that has a planar spiral shape as an example of the inductor wiring line. However, the inductor wiring line is not limited to a spiral wiring line. For example, the inductor wiring line may be a wiring line that has a three-dimensional helical shape. A three-dimensional helical shape is the shape of a helical coil that is formed by connecting wiring lines each of which has less than one turn to one another. In addition, for example, the inductor wiring line may be a substantially C-shaped wiring line that includes two vertical wiring lines each extending in a lamination direction and a horizontal wiring line extending in a direction perpendicular to the lamination direction from one of the vertical wiring lines to the other of the vertical wiring lines. Alternatively, the inductor wiring line may be any one of commonly known wiring lines having various shapes, such as a wiring line having a meandering shape.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a multilayer body including a magnetic layer; and an inductor wiring line disposed in the multilayer body, wherein the magnetic layer includes a base resin, a metal magnetic powder, and a non-magnetic powder, the base resin having voids, and the metal magnetic powder and the non-magnetic powder being contained in the base resin, and the metal magnetic powder has a particle that is in contact with at least one of the voids and with the non-magnetic powder.

2. The inductor component according to claim 1, wherein the non-magnetic powder includes silica.

3. The inductor component according to claim 1, wherein particles of the metal magnetic powder and particles of the non-magnetic powder each have a spherical shape.

4. The inductor component according to claim 1, wherein the metal magnetic powder contains iron.

5. The inductor component according to claim 4, wherein the metal magnetic powder contains from 1 wt % to 5 wt % of chrome.

6. The inductor component according to claim 1, wherein the metal magnetic powder has an average particle diameter of from 1 μm to 5 μm, and the non-magnetic powder has an average particle diameter that is smaller than the average particle diameter of the metal magnetic powder.

7. The inductor component according to claim 1, wherein a particle diameter of the non-magnetic powder that is in contact with the metal magnetic powder is one-third or less of a particle diameter of the metal magnetic powder, which is in contact with the non-magnetic powder.

8. The inductor component according to claim 1, wherein in a lamination direction of the multilayer body, there are a plurality of particles of the metal magnetic powder that are each in contact with at least one of the voids and with the non-magnetic powder.

9. The inductor component according to claim 1, wherein the magnetic layer further includes ferrite powder.

10. The inductor component according to claim 1, wherein the base resin contains at least one of an epoxy-based resin and an acrylic resin.

11. The inductor component according to claim 1, wherein a cross-sectional shape of at least one of the voids that is in contact with the metal magnetic powder has different lengths in two orthogonal directions.

12. The inductor component according to claim 1, wherein a diameter of at least one of the voids that is in contact with the metal magnetic powder is smaller than a diameter of the metal magnetic powder that is in contact with the void.

13. The inductor component according to claim 1, wherein the multilayer body includes a non-magnetic insulator that is in contact with the inductor wiring line, and the inductor component further includes a vertical wiring line that extends through the multilayer body in the lamination direction of the multilayer body from the inductor wiring line to a surface of the multilayer body.

14. The inductor component according to claim 13, wherein at least one of the voids that is in contact with the metal magnetic powder is also in contact with the vertical wiring line.

15. The inductor component according to claim 13, further comprising:

an external terminal formed on a main surface of the multilayer body, wherein the external terminal is disposed on an exposed surface of the vertical wiring line exposed at the main surface of the multilayer body.

16. The inductor component according to claim 13, wherein the insulator includes at least one of an epoxy-based resin, an acrylic resin, a phenolic resin, a polyimide-based resin, and a liquid crystal polymer-based resin and also includes at least one of resins contained in the base resin.

17. The inductor component according to claim 6, wherein the inductor component has a thickness of 0.5 mm or smaller.

18. The inductor component according to claim 1, wherein the inductor wiring line includes a plurality of inductor wiring layers laminated together.

19. The inductor component according to claim 1, further comprising:

a plurality of the inductor wiring lines arranged on the same plane.

20. The inductor component according to claim 2, wherein particles of the metal magnetic powder and particles of the non-magnetic powder each have a spherical shape.

* * * * *